US010941352B2

(12) United States Patent
Lapinski et al.

(10) Patent No.: US 10,941,352 B2
(45) Date of Patent: Mar. 9, 2021

(54) PROCESSES FOR INCREASING AN OCTANE VALUE OF A GASOLINE COMPONENT

(71) Applicant: UOP LLC, Des Plaines, IL (US)

(72) Inventors: Mark P. Lapinski, Aurora, IL (US); Michael W. Penninger, Chicago, IL (US); Rajeswar Gattupalli, Buffalo Grove, IL (US); Christopher D. DiGiulio, Elmhurst, IL (US); Bryan J. Egolf, Crystal Lake, IL (US); Louis A. Lattanzio, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/454,517

(22) Filed: Jun. 27, 2019

(65) Prior Publication Data

US 2020/0407649 A1 Dec. 31, 2020

(51) Int. Cl.

| | |
|---|---|
| ***C10G 35/00*** | (2006.01) |
| ***C10G 35/085*** | (2006.01) |
| ***C10G 7/02*** | (2006.01) |
| ***C10G 61/10*** | (2006.01) |

(52) U.S. Cl.

CPC ..... *C10G 35/085* (2013.01); *C10G 7/02* (2013.01); *C10G 61/10* (2013.01); *C10G 2300/104* (2013.01); *C10G 2300/1044* (2013.01); *C10G 2400/02* (2013.01)

(58) Field of Classification Search

CPC ..... C10G 63/02; C10G 7/02; C10G 35/04; C10G 35/24; C10G 45/32; C10G 2300/1081; C10G 2300/1096; C10G 2300/305; C10G 2300/4018; C10G 2400/02; C10G 2400/20; C10G 2400/22

See application file for complete search history.

(56) References Cited

U.S. PATENT DOCUMENTS

| | | | | |
|---|---|---|---|---|
| 4,222,854 | A * | 9/1980 | Vorhis, Jr. | C10G 59/06 208/139 |
| 5,091,074 | A * | 2/1992 | Maxwell | C10L 1/06 208/79 |
| 7,612,246 | B2 | 11/2009 | Broutin et al. | |
| 8,470,165 | B2 | 6/2013 | Cosyns et al. | |
| 9,024,097 | B2 | 5/2015 | Serban et al. | |
| 9,029,618 | B2 | 5/2015 | Serban et al. | |
| 9,079,817 | B2 | 7/2015 | Moser et al. | |
| 2013/0158320 | A1 | 6/2013 | Moser et al. | |
| 2014/0378700 | A1 | 12/2014 | Majumder et al. | |

FOREIGN PATENT DOCUMENTS

| | | |
|---|---|---|
| GB | 1186095 | 4/1970 |

* cited by examiner

*Primary Examiner* — Prem C Singh
*Assistant Examiner* — Brandi M Doyle

(57) ABSTRACT

Processes for producing a gasoline blend in which $C_7$ hydrocarbons are separated from a naphtha feed. The $C_7$ hydrocarbons are isomerized and dehydrogenated to increase the octane value of the components therein. In order to avoid conversion of methylcyclohexane to toluene in the dehydrogenation reactor, the various processes provide flow schemes in which the methylcyclohexane bypasses the $C_7$ dehydrogenation reaction zone.

20 Claims, 12 Drawing Sheets

PROCESSES FOR INCREASING AN OCTANE VALUE OF A GASOLINE COMPONENT

FIELD OF THE INVENTION

This invention relates generally to a process for producing high octane gasoline and more particularly to processes which incorporate a dehydrogenation unit increase the octane value of a gasoline component by converting $C_7$ saturated hydrocarbons to their corresponding olefins.

BACKGROUND OF THE INVENTION

Gasoline specifications are becoming stricter and more difficult for refiners to meet. For hydrocracker-based refineries, which rely on the reforming and isomerization units to produce gasoline, it is difficult to meet the aromatics specifications in the Euro V gasoline standard while maximizing 95 RON (research octane number). Euro V standards limit gasoline to concentrations of no more than 35 lv % aromatics and no more than 1.0 lv % benzene with additional limitations on distillation and Reid vapor pressure (RVP). It is common that a refiner cannot process as much reformer feed due to the aromatics limitation thus resulting in the need to sell heavy naphtha that has lower value, thus reducing the refiner's profitability. A refiner can add oxygenates such as methyl tert-butyl ether (MTBE) or tertiary amyl methyl ether (TAME) to the gasolines to increase octane, but these can be expensive and there may be additional environmental regulations against these compounds. The Euro V specifications also limit the amount of olefins that can be added to the gasolines to 18 lv %. For hydrocracker-based, condensate-based or other refineries that do not add a significant amount of olefins to the gasolines, producing an olefin stream can be advantageous due to an increase in octane over paraffins. Since these refineries have low olefins in their gasolines, a significant amount of olefins can be blended into the gasolines up to the specification.

In a typical naphtha complex configuration, a naphtha splitter distillation column fractionates a hydrotreated full range naphtha stream into light naphtha and heavy naphtha. The light naphtha stream containing $C_5$ and $C_6$ species goes to the isomerization unit to make an isomerate and the heavy naphtha is processed in the reforming unit to make reformate. It would be desirable to increase the octane value of components from the heavy stream so that they can be used in the gasoline pool instead of as discussed above being sold as a lower value chemical or requiring additional components.

SUMMARY OF THE INVENTION

In the present invention, a $C_7$ stream is fractionated from the naphtha splitter and further separated to produce at least one $C_7$ stream rich in $C_7$ iso-paraffins that is processed in a dehydrogenation zone and a second stream that is rich in n-heptane and methylcyclohexane that is processed in an isomerization zone. In the dehydrogenation zone, the stream rich in $C_7$ isoparaffins is partially converted to higher octane $C_7$ iso-olefins. In the isomerization zone, the stream rich in n-heptane and methylcyclohexane is partially converted to higher octane $C_7$ isoparaffins and $C_7$ cyclopentanes. It is desired in the present invention to control the separations to limit the amount of cyclohexane and methylcyclohexane in the feed to the dehydrogenation zone since these will dehydrogenate to benzene and toluene which are not desired due to the gasoline benzene and aromatic specifications. It is also desired to dehydrogenate a $C_7$ stream rich in $C_7$ isoparaffins since these components form higher octane mono-olefins as compared to a stream rich in n-heptane which will dehydrogenate to normal $C_7$ mono-olefins with lower octanes.

There are several advantages for dehydrogenating the $C_7$ compounds. First, the $C_7$ compounds are not converted to aromatics in the reformer. Additionally, some of the $C_7$ compounds are upgraded to higher octane via the production of high-octane $C_7$ olefins and other $C_7$ compounds are upgraded via from the production of higher octane $C_7$ iso-paraffins and $C_7$ cyclopentanes. These facilitate the production of a greater amount of gasoline that meets the Euro V specifications and reduce the amount of lower value heavy naphtha that needs to be sold. There is additional hydrogen generated by the dehydrogenation unit that can be recirculated to the reformer, isomerization unit or other process units.

The various processes described herein provide processes for efficiently and effectively processing feed streams that include appreciable amounts of MCH and minimize the conversion of MCH to toluene in the dehydrogenation reaction zone.

Therefore, the present invention may be broadly characterized, in at least one aspect, as providing a process for producing a gasoline blend by: separating a naphtha feed in a fractionation column into a stream comprising $C_6$ and lighter boiling hydrocarbons, one or more $C_7$ hydrocarbon streams comprising methylcyclohexane, $iC_7$, and $nC_7$, and a heavy stream comprising $C_8$ hydrocarbons; isomerizing, in a $C_6$ isomerization zone at isomerization conditions, at least a portion of the stream comprising $C_6$ and lighter boiling hydrocarbons to form a $C_6$ isomerization effluent; isomerizing, in a $C_7$ isomerization zone at isomerization conditions, at least the $nC_7$ from the one or more $C_7$ hydrocarbon streams comprising methylcyclohexane, $iC_7$, and $nC_7$ to form a $C_7$ isomerization effluent; dehydrogenating, in a $C_7$ dehydrogenation zone at dehydrogenation conditions, the $iC_7$ from the one or more $C_7$ hydrocarbon streams comprising methylcyclohexane, $iC_7$, and $nC_7$ to form a $C_7$ dehydrogenation effluent, wherein the methylcyclohexane of the one or more $C_7$ hydrocarbon stream comprising methylcyclohexane, $iC_7$, and $nC_7$ bypasses the $C_7$ dehydrogenation zone; reforming, in a reforming zone under reforming conditions, the heavy stream to form a reformate stream; and, blending the $C_6$ isomerization effluent, the reformate stream, the $C_7$ dehydrogenation effluent, and the $C_7$ isomerization effluent to form the gasoline blend.

In a second aspect, the present invention may be generally characterized, in at least one aspect, as providing a process for producing a gasoline blend, the process comprising separating a naphtha feed into a stream comprising $C_6$ and lighter boiling hydrocarbons, a $C_7$ hydrocarbon stream comprising methylcyclohexane, $iC_7$, and $nC_7$, and a heavy stream comprising $C_8$ hydrocarbons; isomerizing, in a $C_6$ isomerization zone at isomerization conditions, at least a portion of the stream comprising $C_6$ and lighter boiling hydrocarbons to form a $C_6$ isomerization effluent; separating the $C_7$ hydrocarbon stream in a $C_7$ separation zone into an $iC_7$ stream and an $nC_7$ and methylcyclohexane stream; isomerizing, in a $C_7$ isomerization zone at isomerization conditions, the $nC_7$ and methylcyclohexane stream from the $C_7$ separation zone to form a $C_7$ isomerization effluent; dehydrogenating, in a $C_7$ dehydrogenation zone at dehydrogenation conditions, the $iC_7$ from the $C_7$ separation zone to form a $C_7$ dehydrogenation effluent; reforming, in a reforming zone under reforming conditions, the heavy stream to form a reformate stream; and, blending the $C_6$ isomerization effluent, the reformate stream, the $C_7$ dehydrogenation effluent, and the $C_7$ isomerization effluent to form the gasoline blend.

According to a third aspect, the present invention may be broadly characterized as providing a process for producing a gasoline blend by: separating a naphtha feed into a stream comprising $C_6$ and lighter boiling hydrocarbons, a $C_7$ hydrocarbon stream comprising methylcyclohexane, $iC_7$, and $nC_7$, and a heavy stream comprising $C_8$ hydrocarbons; isomerizing, in a $C_6$ isomerization zone at isomerization conditions, at least a portion of the stream comprising $C_6$ and lighter boiling hydrocarbons to form a $C_6$ isomerization effluent; isomerizing, in a $C_7$ isomerization zone at isomerization conditions, the $C_7$ hydrocarbon stream comprising methylcyclohexane, $iC_7$, and $nC_7$ to form a $C_7$ isomerization effluent; separating the $C_7$ isomerization effluent in a $C_7$ separation zone into an $iC_7$ stream and an MCH rich stream; dehydrogenating, in a $C_7$ dehydrogenation zone at dehydrogenation conditions, the $iC_7$ stream; reforming, in a reforming zone under reforming conditions, the heavy stream to form a reformate stream; and, blending the $C_6$ isomerization effluent, the reformate stream, the $C_7$ dehydrogenation effluent, and the $C_7$ isomerization effluent to form the gasoline blend.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present invention will be described below in conjunction with the following drawing figures, in which.

DETAILED DESCRIPTION OF THE INVENTION

Figure 1:
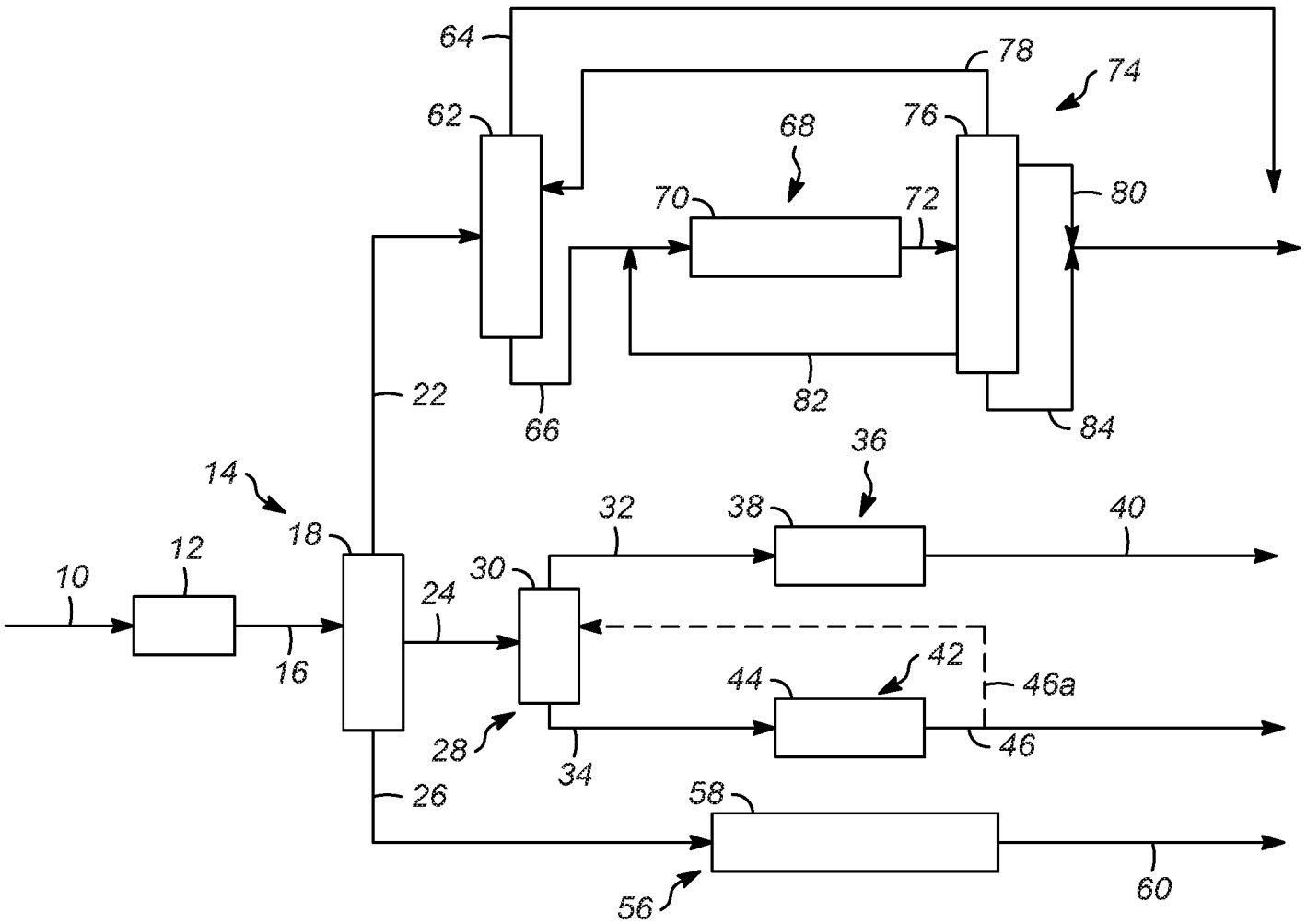
FIG. 1 shows a process flow diagram according to various aspects of the present invention.

As mentioned above, various processes have been invented which minimize the dehydrogenation of MCH to toluene and promotes $C_7$ paraffin and $C_7$ cyclo-paraffin dehydrogenation to form $C_7$ olefins and cyclo-olefins to improve the octane value of the $C_7$ spilt from a naphtha feed stream. This invention allows achieving the octane pool requirements, aromatic requirements, processing of heavy naphtha, and does not require addition of MTBE. These processes provide for lower costs, both initial and operating, compared to processes which include $C_7$ isomerization that contain large deisoheptanizer column recycle streams. Specifically, this invention utilizes new configurations of $C_7$ isomerization, fractionation and $C_7$ dehydrogenation specifically to produce olefin-containing streams for addition to the gasoline pool that meet the aromatic spec limit of Euro V gasoline.

A key aspect of these configurations is that the $C_7$ compounds that would form aromatics in the reformer are routed away from the reformer. Cyclohexane and MCH are also routed away from the dehydrogenation reactor so as to minimize the formation of aromatics and prevent quenching of $C_7$ paraffin dehydrogenation reactions to olefins.

To provide lower cost, the $C_7$ isomerization zone can consist of a single reactor operating as hydrocarbon once-through and hydrogen once-through. The isomerization catalyst contains a group VIII element, preferably Pt, on a catalyst support such as chlorided alumina, sulfated-zirconia or zeolitic-containing base. In some embodiments, two or more $C_7$ isomerization reactors in series can be utilized in the isomerization zone.

The dehydrogenation unit has a single reactor. The selective dehydrogenation catalyst contains a group VIII component, a promoter such as Sn, and an alkali and/or alkaline earth component.

Generally, the processes of the present invention fall into two different categories: one $C_7$ stream is provided by the naphtha splitter, or two $C_7$ streams are provided by the naphtha splitter.

In cases falling into the two $C_7$ streams withdrawn from the naphtha splitter, one stream is $iC_7$ rich and the other stream is $nC_7$+MCH rich. The $iC_7$ rich stream is fractionated such as to minimize cyclohexane and benzene. The $nC_7$+MCH rich stream cut is sent to isomerization to form higher octane $iC_7$ isomers and $C_7$ cyclopentanes and then separated to make an $iC_7$ rich stream and MCH-rich stream. The $iC_7$ rich stream can be combined with the $iC_7$ stream from the naphtha splitter and sent to $C_7$ dehydrogenation for octane upgrading. The MCH-rich stream is sent to the gasoline pool but it can be partially recycled to isomerize remaining low octane $C_7$ paraffins.

In cases in which a single $C_7$ stream is withdrawn from the naphtha splitter, the $C_7$ stream from the naphtha splitter can be further split to give an $iC_7$ overhead stream and $nC_7$+MCH rich streams. The $nC_7$+MCH rich stream goes to the isomerization reactor to form higher octane $iC_7$ isomers and $C_7$ cyclopentanes. The isomerization exit stream can again be split making $iC_7$ and MCH-rich streams. The MCH-rich stream is sent to the gasoline pool but it can be partially recycled to isomerize remaining low octane $C_7$ paraffins. This minimizes the aromatization of MCH to toluene in the dehydrogenation zone. The $iC_7$ can join the $iC_7$ overhead stream and go directly to the $C_7$ dehydrogenation unit, giving the highest single pass conversion opportunity and highest octane yield.

With these general principles in mind, one or more embodiments of the present invention will be described with the understanding that the following description is not intended to be limiting. Additionally, in the various FIGS., identical elements in the various embodiments have identical reference numbers.

As shown in FIGS. 1 to 12, a naphtha feed stream 10 comprising $C_4$-$C_{12}$ may be first treated in, for example, a hydrotreating unit 12 before being separated in a fractionation zone 14. The naphtha feed stream 10 may have a narrower range of hydrocarbons.

Hydrotreating is a process in which hydrogen gas is contacted with a hydrocarbon stream in the presence of suitable catalysts which are primarily active for the removal of heteroatoms, such as sulfur, nitrogen, and metals from the hydrocarbon feedstock. In hydrotreating, hydrocarbons with double and triple bonds may be saturated. Aromatics may also be saturated. Typical hydrotreating reaction conditions include a temperature of about 290° C. (550° F.) to about 455° C. (850° F.), a pressure of about 3.4 MPa (500 psig) to about 6.2 MPa (900 psig), a liquid hourly space velocity of about 0.5 $h^{-1}$ to about 4 $h^{-1}$, and a hydrogen rate of about 168 to about 1,011 $Nm^3/m^3$ oil (1,000-6,000 scf/bbl). Typical hydrotreating catalysts include at least one Group VIII metal, preferably iron, cobalt and nickel, and at least one Group VI metal, preferably molybdenum and tungsten, on a high surface area support material, preferably alumina. Other typical hydrotreating catalysts include zeolitic catalysts, as well as noble metal catalysts where the noble metal is selected from palladium and platinum.

A hydrotreated effluent 16 is passed to the fractionation zone 14 which comprises at least one fractionation column 18, which may be a naphtha splitter. In the fractionation column 18, according to the embodiments of the present invention shown in FIGS. 1 to 6, the naphtha feed stream 10 is separated into at least a $C_6$ stream 22, a $C_7$ stream 24, and a heavy stream 26. The $C_6$ rich stream 22 comprises $C_6$ and lighter boiling hydrocarbons, the $C_7$ stream 24 comprises $C_7$ hydrocarbons including MCH, and $nC_7$, and the heavy stream 26 comprises $C_8$ and heavier hydrocarbons.

Figure 2:
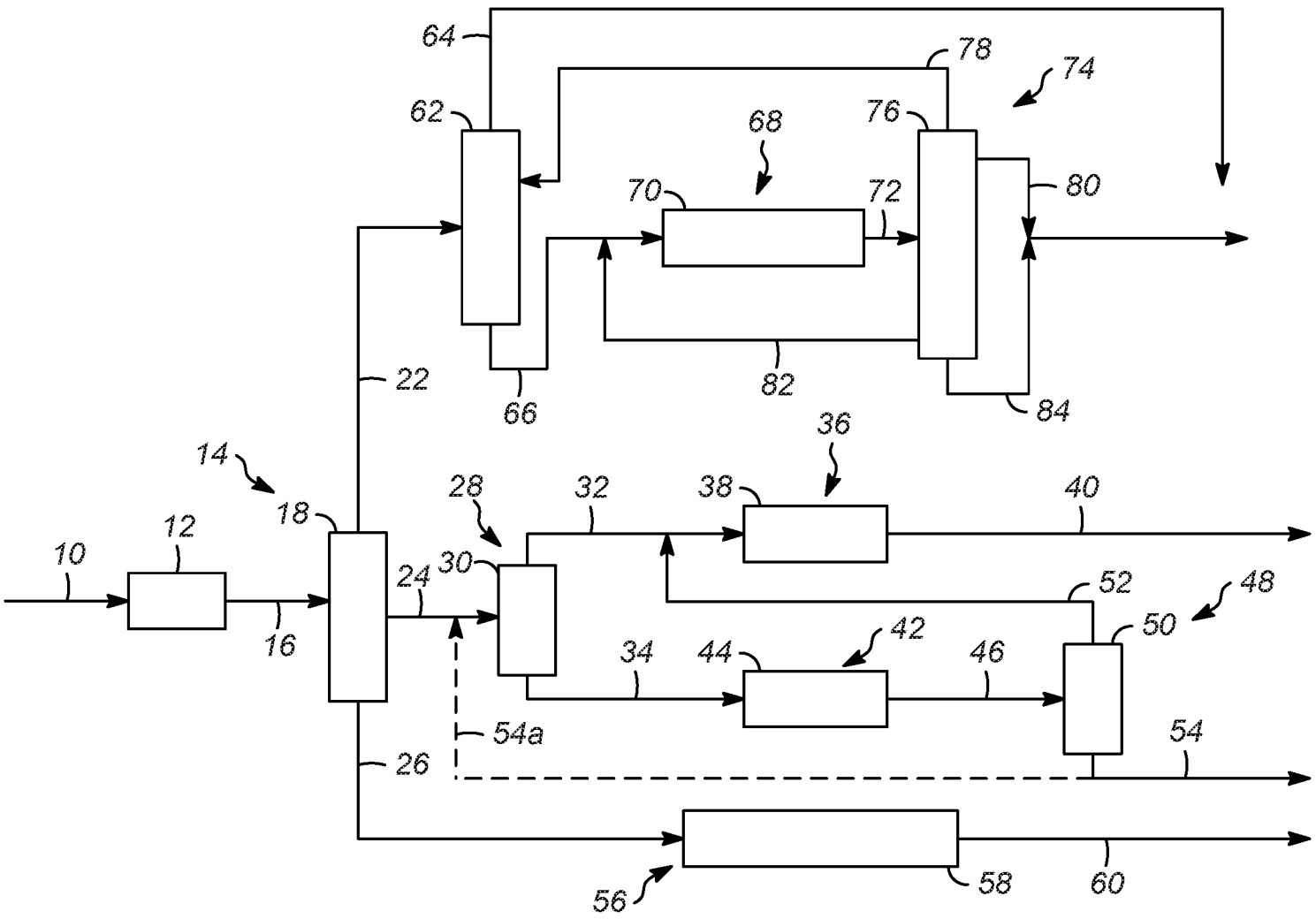
FIG. 2 shows a process flow diagram according to various aspects of the present invention.

To accommodate the MCH and avoid conversion of the MCH to toluene (and the quenching of the dehydrogenation of the other $C_7$ hydrocarbons), the present invention provides various processes. For example, as shown in FIGS. 1 and 2, the $C_7$ stream 24 is passed to a $C_7$ separation zone 28 having a fractionation column 30, such as a deisoheptanizer. The fractionation column 30 provides an $iC_7$ stream 32 and an $nC_7$ and MCH stream 34. The $iC_7$ stream 32 is passed to a $C_7$ dehydrogenation zone 36 and the $nC_7$ and MCH stream 34 is passed to a $C_7$ isomerization zone 42.

In another embodiment (not shown), separation zone 28 can contain a three-cut fractionation column that provides an overhead stream that contains multi-branched $iC_7$s, cyclohexane and benzene, a side draw stream that contains single-branched $iC_7$s, and a bottoms stream that contains $nC_7$ and MCH. The overhead stream can be sent to gasoline blending or to a benzene saturation unit and then to gasoline blending. The sidedraw stream is passed to the dehydrogenation zone. The bottoms stream is passed to the $C_7$ isomerization zone.

As mentioned above, $iC_7$ stream 32 is combined with a hydrogen stream (not shown), heated and passed to the $C_7$ dehydrogenation zone 36. The $C_7$ dehydrogenation zone 36 comprises a reactor 38 which contains a catalyst to convert a portion of the saturated hydrocarbons in the $iC_7$ stream 32 to olefins in the presence of hydrogen over a selective platinum dehydrogenation catalyst. Specifically, $C_7$ iso-paraffins are dehydrogenated to the corresponding iso-$C_7$ monoolefins. For example, a multibranched $iC_7$, 2,4-dimethylpentane is dehydrogenated to 2,4-dimethyl-1-pentene and 2,4-dimethyl-2-pentene. A single-branched $iC_7$, 2-methylhexane is dehydrogenated to 2-methyl-1-hexene, 2-methyl-2-hexene, cis-2-methyl-3-hexene, trans-2-methyl-3-hexene, 5-methyl-1-hexene, cis-5-methyl-2-hexene and trans-5-methyl-2-hexene. Cyclopentane compounds are dehydrogenated to cyclopentene compounds.

The dehydrogenation process may utilize any suitable selective dehydrogenation catalyst. Generally, one preferred suitable catalyst comprises a Group VIII noble metal component (e.g., platinum, iridium, rhodium, and palladium), an alkali metal component, and a porous inorganic carrier material. The catalyst may also contain promoter metals which advantageously improve the performance of the catalyst. The porous carrier material should be relatively refractory to the conditions utilized in the reaction zone and may be chosen from those carrier materials which have traditionally been utilized in dual function hydrocarbon conversion catalysts. A preferred porous carrier material is a refractory inorganic oxide, with the most preferred an alumina carrier material. The particles are usually spheroidal and have a diameter of from about 1.6 to about 3.2 mm (about 1/16 to about 1/8 inch) about 1.6 to about 3.2 mm, although they may be as large as about 6.4 mm (about 1/4 inch). Newer dehydrogenation catalysts can also be used in this process.

For example, one such catalyst comprises a layered catalyst composition comprising an inner core, and outer layer bonded to the inner core so that the attrition loss is less than 10 wt % based on the weight of the outer layer. The outer layer is a refractory inorganic oxide. Uniformly dispersed on the outer layer is at least one platinum group metal, and a promoter metal. The inner core and the outer layer are made of different materials. A modifier metal is also dispersed on the outer layer. The inner core is made from alpha alumina, theta alumina, silicon carbide, metals, cordierite, zirconia, titania, and mixtures thereof. The outer refractory inorganic oxide is made from gamma alumina, delta alumina, eta alumina, theta alumina, silica/alumina, zeolites, non-zeolitic molecular sieves, titania, zirconia, and mixtures thereof. The platinum group metals include platinum, palladium, rhodium, iridium, ruthenium, osmium, and mixtures thereof. The platinum group metal is present in an amount from about 0.01 to about 5 wt % of the catalyst composition. The promoter metal includes tin, germanium, rhenium, gallium, bismuth, lead, indium, cerium, zinc, and mixtures thereof. The modifier metal includes alkali metals, such as potassium and lithium, alkaline earth metals, and mixtures thereof. Further discussion of two layered dehydrogenation catalysts can be found in U.S. Pat. No. 6,617,381, which is incorporated herein by reference, for example.

The process conditions utilized for dehydrogenation are usually 0 to 345 kPa (0 to 50 psig), 0.5 to 6 hydrogen/hydrocarbon mole ratio, inlet reactor temperatures of 450 to 600° C. (845 to 1112° F.), and 1 to 30 $h^{-1}$ LHSV. Conditions preferred for $C_7$ hydrocarbon feed stocks are 138 to 276 kPa (20 to 40 psig), about 3 to 5 hydrogen/hydrocarbon mole ratio, inlet reactor temperatures of about 520 to 560° C. (968 to 1040° F.), and about 5 to 10 $h^{-1}$ LHSV. Adiabatic radial-flow reactors are used to minimize pressure drop within an efficient reactor volume. Hydrogen and some by-product light ends are typically separated (not shown) from the $C_7$ dehydrogenation effluent 40, and a part of this hydrogen gas may be recycled back to the dehydrogenation reactor 38 to minimize coking and enhance catalyst stability.

The $C_7$ dehydrogenation effluent 40 comprising an increased olefins content compared to an olefins content of the $C_7$ stream 24 may be added to a gasoline pool to bolster octane value of the gasoline blend. Although not depicted as such, the $C_7$ stream 24 may first be passed to a selective hydrogenation zone (not shown in the FIGS.) for the selective conversion of diolefins to mono-olefins. In such a process, a hydrogen stream is also charged to the selective hydrogenation reactor. Typical selective hydrogenation conditions utilized are 25 to 350° C. (77 to 662° F.), 276 kPa to 5.5 MPa) (40 to 800 psig), 5-35 $h^{-1}$ LHSV and a hydrogen to diolefin mole ratio of between about 1.4 to 2.0. The selective hydrogenation reactor effluent passes to a stripper (not shown) where dissolved light hydrocarbons are removed and the stripper bottoms, a mixture of mono-olefin hydrocarbons and unconverted saturated hydrocarbons stream are sent for blending in gasoline pool. Other streams from the process are also blended to form the gasoline.

The $C_7$ isomerization zone 42 comprises at least one reactor 44 as well as feed-effluent heat exchangers, inter-reactor heat exchangers, driers, sulfur guards, separator, stabilizer, compressors, deisopentanizer column, recycle streams and other equipment as known in the art (not shown). The reactor 44 of the $C_7$ isomerization zone 42 includes an isomerization catalyst and is operated under conditions for converting normal and single branched paraffins in the $nC_7$ and MCH stream 34 into multi-branched paraffins. Additionally, within the $C_7$ isomerization zone 42 some $C_7$ cyclopentanes and MCH are also isomerized.

Any suitable isomerization catalyst may be used in the $C_7$ isomerization zone 42. Suitable isomerization catalysts include acidic catalysts using chloride for maintaining the sought acidity and sulfated catalysts. The isomerization catalyst may be amorphous, e.g., based upon amorphous alumina, or zeolitic. A zeolitic catalyst would still normally contain an amorphous binder. The catalyst may include a sulfated zirconia and platinum as described in U.S. Pat. No. 5,036,035 and European application 0 666 109 or a platinum group metal on chlorided alumina as described in U.S. Pat. Nos. 5,705,730 and 6,214,764. Another suitable catalyst is described in U.S. Pat. No. 5,922,639. U.S. Pat. No. 6,818, 589 discloses a catalyst including a tungstated support of an oxide or hydroxide of a Group IVB (TUPAC 4) metal, for example zirconium oxide or hydroxide, at least a first component which is a lanthanide element and/or yttrium component, and at least a second component being a platinum-group metal component.

Contacting within the reactor 44 of the $C_7$ isomerization zone 42 may be effected using the catalyst in a fixed-bed system, a moving-bed system, a fluidized-bed system, or in a batch-type operation. A fixed-bed system may be employed in an exemplary embodiment. The reactants may be contacted with the bed of catalyst particles in upward, downward, or radial-flow fashion. The reactants may be in the liquid phase, a mixed liquid-vapor phase, or a vapor phase when contacted with the catalyst particles.

Isomerization conditions in the within the reactor 44 of the $C_7$ isomerization zone 42 may include reactor temperatures that may be from 40 to 250° C. Lower reaction temperatures (within the stated range) may be employed in order to favor multi-branched $iC_7$ component equilibrium mixtures having the highest concentration of high-octane highly branched isoalkanes and to minimize cracking of the feed to lighter hydrocarbons. Temperatures from 100 to 200° C. (212 to 392° F.) may be employed in some embodiments. Reactor operating pressures may be from 100 kPa to 10 MPa absolute (14.5 to 1,450 psi), for example from 0.5 MPa to 4 MPa absolute (72.5 to 580 psi). Liquid hourly space velocities may be from 0.2 to 25 volumes of isomerizable hydrocarbon feed per hour per volume of catalyst, for example from 0.5 to 15 $hr^{-1}$.

A $C_7$ isomerization effluent 46 may be blended with the $C_7$ dehydrogenation effluent 40 in the gasoline pool. Additionally, a portion 46*a* of the $C_7$ isomerization effluent 46 may be recycled to the fractionation column in the $C_7$ separation zone 28 so that $iC_7$ in the $C_7$ isomerization effluent 46 can be converted in the $C_7$ dehydrogenation zone 36.

Turning to FIG. 2, a second $C_7$ separation zone 48 comprising a fractionation column 50, such as a second deisoheptanizer is used to separate the $C_7$ isomerization effluent 46 into an $iC_7$ rich stream 52, which may be combined with the $iC_7$ stream 32 from the first $C_7$ separation zone 28 and passed to the $C_7$ dehydrogenation zone 36. An MCH rich stream 54 comprising MCH and unconverted $nC_7$ from the second $C_7$ separation zone 48 may be used as a gasoline pool component. A portion 54*a* of the MCH rich stream 54 may also be recycled back to the first $C_7$ separation zone 28, as discussed above.

Returning to the fractionation zone 14 in FIGS. 1 and 2, the heavy stream 26 from the fractionation zone 14 may be passed to a reforming zone 56. Generally, the reforming zone 56 includes a number of reactors (or reaction zones) 58, but usually the number of reactors is three, four, or five. Since reforming reactions occur generally at an elevated temperature and are generally endothermic, each reactor 58 usually has associated with it one or more heating zones, which heat the reactants and inter-reactor effluents to the desired reaction temperature. A final effluent stream 60 from the reforming zone 56 may also be blended with the $C_7$ dehydrogenation effluent 40 for the gasoline blend.

Similarly, as shown in FIGS. 1 and 2, the $C_6$ rich stream 22 from the fractionation zone 14 may be passed to a fractionation column 62 to separate the components into, for example, a $C_5$ stream 64 comprising $iC_5$ hydrocarbons, and a second $C_6$ stream 66 comprising $C_6$ hydrocarbons. The $C_5$ stream 64 comprising $iC_5$ hydrocarbons may be blended with the other streams for the gasoline blend.

The second $C_6$ stream 66, which will also include, for example, $nC_5$ hydrocarbons, is passed to an $C_6$ isomerization zone 68 where the $C_5$ and $C_6$ hydrocarbons will be isomerized. The $C_6$ isomerization zone 68 can be any type of isomerization zone that takes a stream of $C_5$ and $C_6$ straight-chain hydrocarbons or a mixture of straight-chain, branched-chain, cyclic hydrocarbons, and benzene and converts straight-chain hydrocarbons in the feed mixture to branched-chain hydrocarbons and branched hydrocarbons to more highly branched hydrocarbons, thereby producing an effluent having branched-chain and straight-chain hydrocarbons. The cycloparaffins can isomerize between cyclopentanes and cyclohexane compounds. Benzene can be saturated to form cyclohexane.

In some embodiments, the $C_6$ isomerization zone 68 can include one or more isomerization reactors 70, as well as feed-effluent heat exchangers, inter-reactor heat exchangers, driers, sulfur guards, separator, stabilizer, compressors, pumps, hydrogen recycle stream and other equipment as known in the art (not shown). A hydrogen-rich gas stream (not shown) is typically mixed with the second $C_6$ stream 66 and heated to reaction temperatures. The hydrogen-rich gas stream, for example, comprises about 50-100 mol % hydrogen. The hydrogen can be separated from the reactor effluent, compressed and recycled back to mix with the light stream. The second $C_6$ stream 66 and hydrogen are contacted in the $C_6$ isomerization zone 68 with an isomerization catalyst forming a $C_6$ isomerization effluent 72.

The catalyst composites that can be used in the $C_6$ isomerization zone 68 include traditional isomerization catalysts including chlorided platinum alumina, crystalline aluminosilicates or zeolites, and other solid strong acid catalysts such as sulfated zirconia and modified sulfated zirconia. Suitable catalyst compositions of this type will exhibit selective and substantial isomerization activity under the operating conditions of the process. Operating conditions within the $C_6$ isomerization zone 68 are selected to maximize the production of isoalkane product from the feed components. Temperatures within the isomerization zone will usually range from about 40 to about 235° C. (100 to 455° F.). Lower reaction temperatures usually favor equilibrium mixtures of isoalkanes versus normal alkanes. Lower temperatures are particularly useful in processing feeds composed of $C_5$ and $C_6$ alkanes where the lower temperatures favor equilibrium mixtures having the highest concentration of the most branched isoalkanes. When the feed mixture is primarily $C_5$ and $C_6$ alkanes, temperatures in the range of from about 60 to about 160° C. (140 to 320° F.) are suitable. The $C_6$ isomerization zone 68 may be maintained over a wide range of pressures. Pressure conditions in the isomerization of $C_4$ to $C_6$ paraffins range from about 700 kPa(a) to about 7,000 kPa(a) (102 to 1,015 psi). In other embodiments, pressures for this process are in the range of from about 2,000 kPa(g) to 5,000 kPa(g) (290 to 725 psi). The feed rate to the reaction zone can also vary over a wide range. These conditions include liquid hourly space velocities ranging from about 0.5 to about 12 $h^{-1}$ however, with some embodiments having space velocities between about 1 and about 6 $h^{-1}$.

The $C_6$ isomerization effluent 72 is passed to a fractionation zone 74 comprising, for example, a deisohexanizer column 76 to separate the components of the $C_6$ isomerization effluent 72 into a plurality of streams, including, an overhead stream 78 comprising $iC_5$ and $nC_5$, and an $iC_6$ stream 80, a recycle stream 82 comprising $nC_6$ hydrocarbons, and a bottoms stream 84 comprising $C_7$ and heavier hydrocarbons. The bottoms stream 84 and the $iC_6$ stream 80 streams may be blended to form one stream for gasoline pool blending. The overhead stream 78 may be recycled to the fractionation column 62, while the recycle stream 82 is combined with the $C_6$ isomerization feed stream 66.

Figure 3:
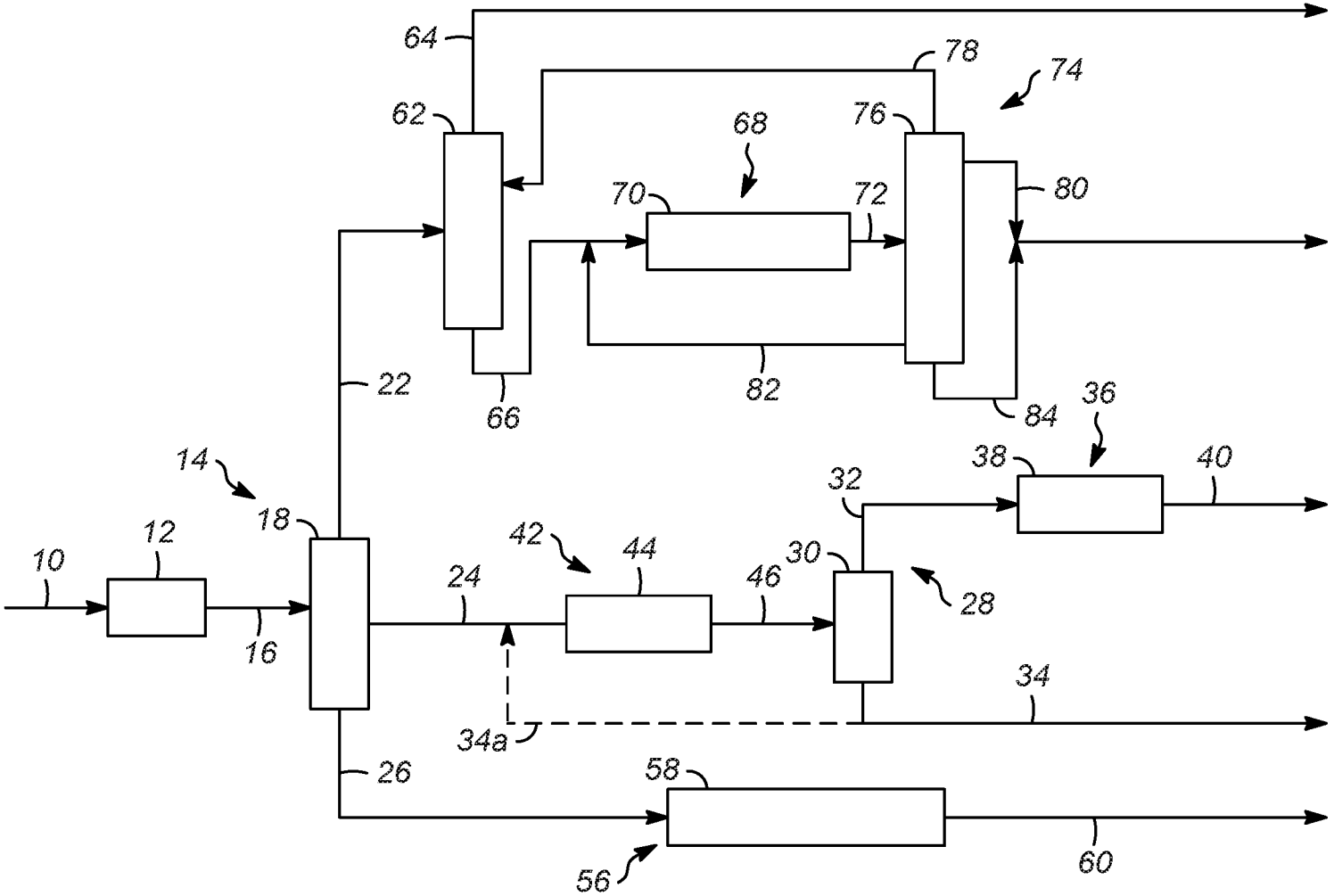
FIG. 3 shows a process flow diagram according to various aspects of the present invention.

Turning to FIG. 3, in this embodiment, the $C_7$ stream 24 from the fractionation zone 14 is passed first to the $C_7$ isomerization zone 42. Thus, the feed to the $C_7$ isomerization zone 42 includes $nC_7$, $iC_7$, MCH, The $C_7$ isomerization effluent 46 is then passed to the $C_7$ separation zone 28 to provide the $iC_7$ steam 32 and the MCH and $nC_7$ stream 34, which is rich in MCH. A portion 34*a* of the MCH and $nC_7$ stream 34 may be recycled to the $C_7$ isomerization zone 42, while the remainder may be blended to the form the gasoline blend. The $iC_7$ stream 32 is passed to the $C_7$ dehydrogenation zone 36, and the $C_7$ dehydrogenation effluent 40 is used to the form the gasoline blend. As with previous embodiments, the $C_7$ dehydrogenation effluent 40 may first be passed to a selective hydrogenation zone (not shown) for the selective conversion of diolefins to mono-olefins. Such a selective hydrogenation zone is described above. The remaining portions of this embodiment are the same as the others and are hereby incorporated herein as if set forth fully.

Figure 4:
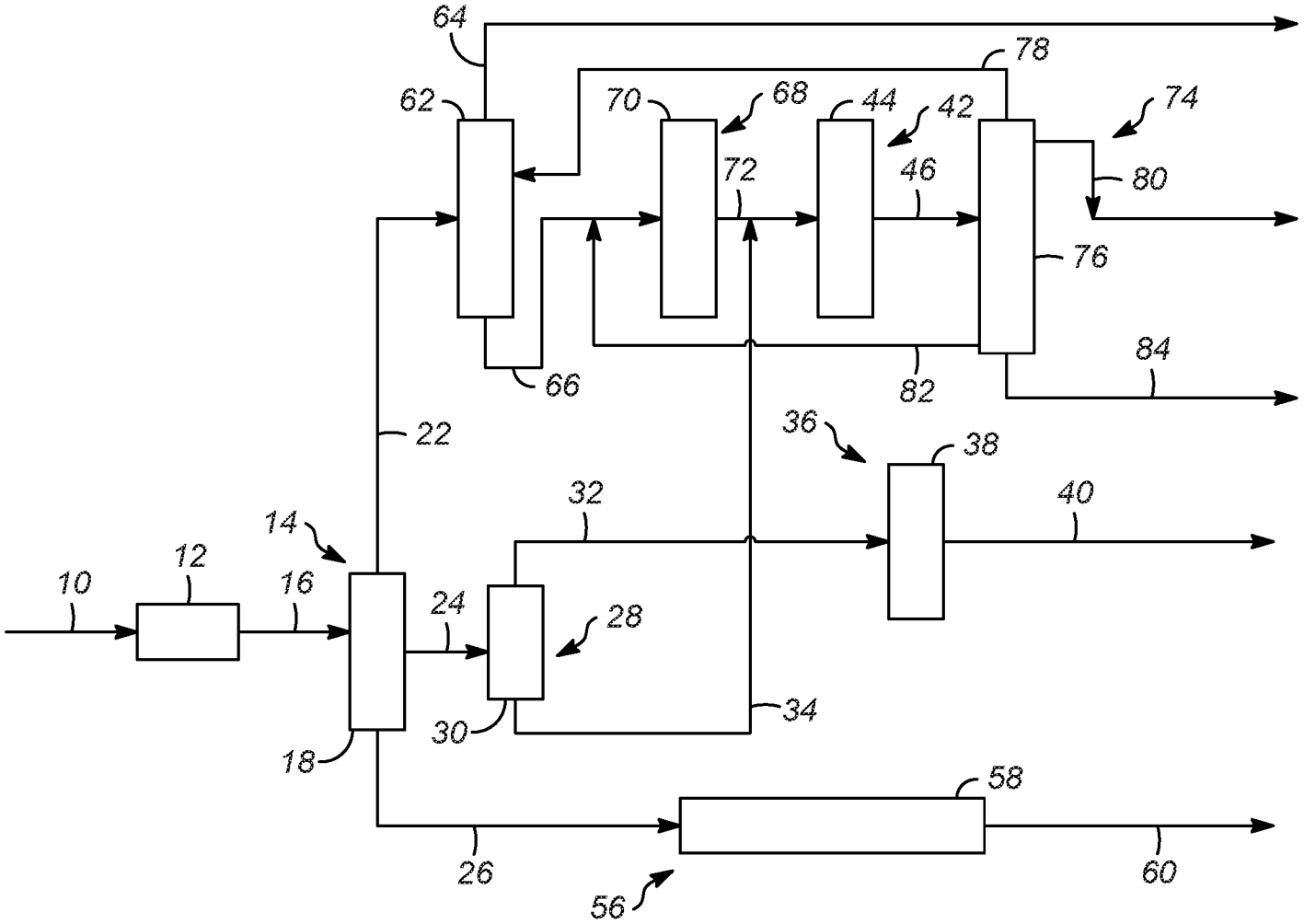
FIG. 4 shows a process flow diagram according to various aspects of the present invention.
Figure 5:
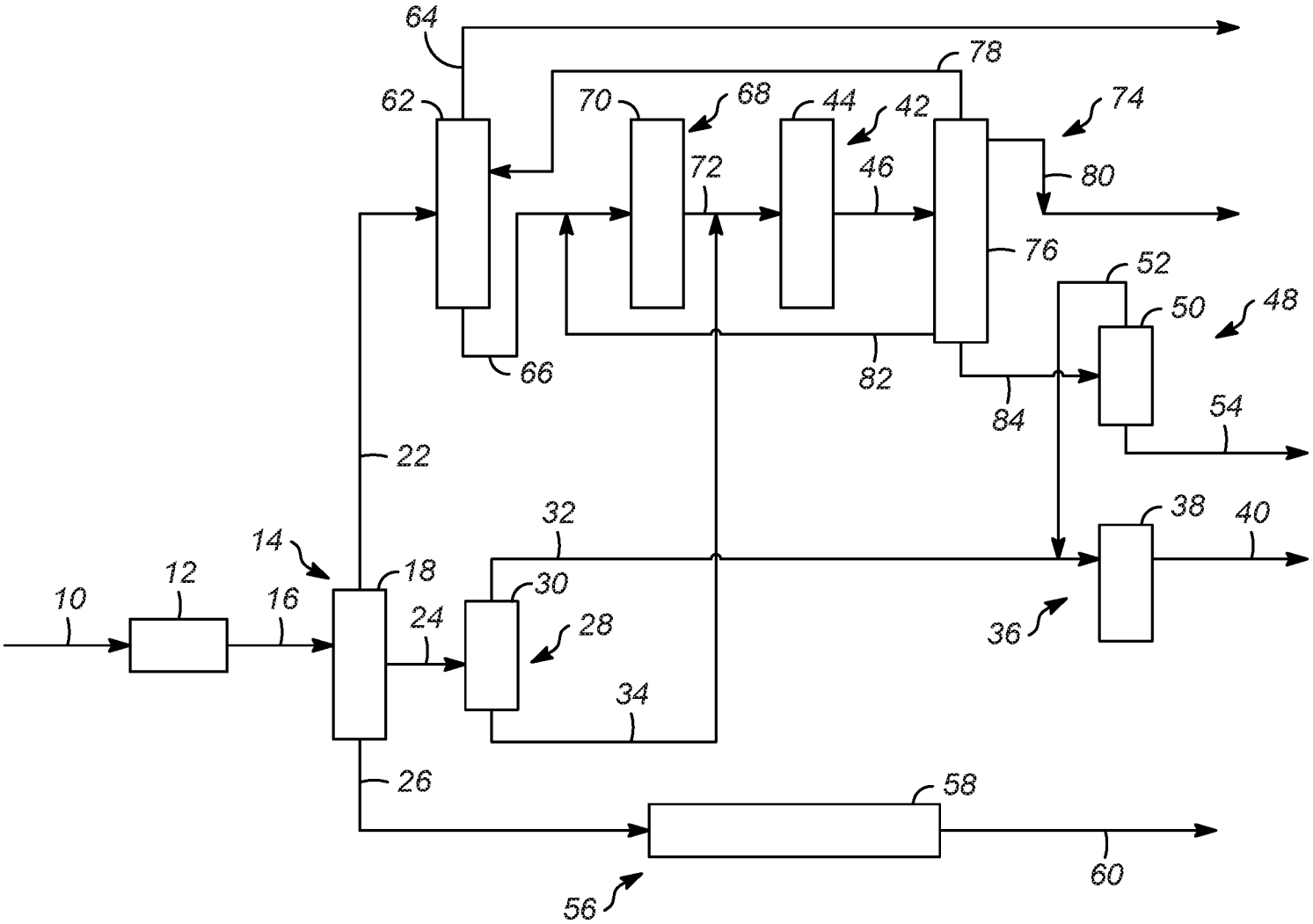
FIG. 5 shows a process flow diagram according to various aspects of the present invention.
Figure 6:
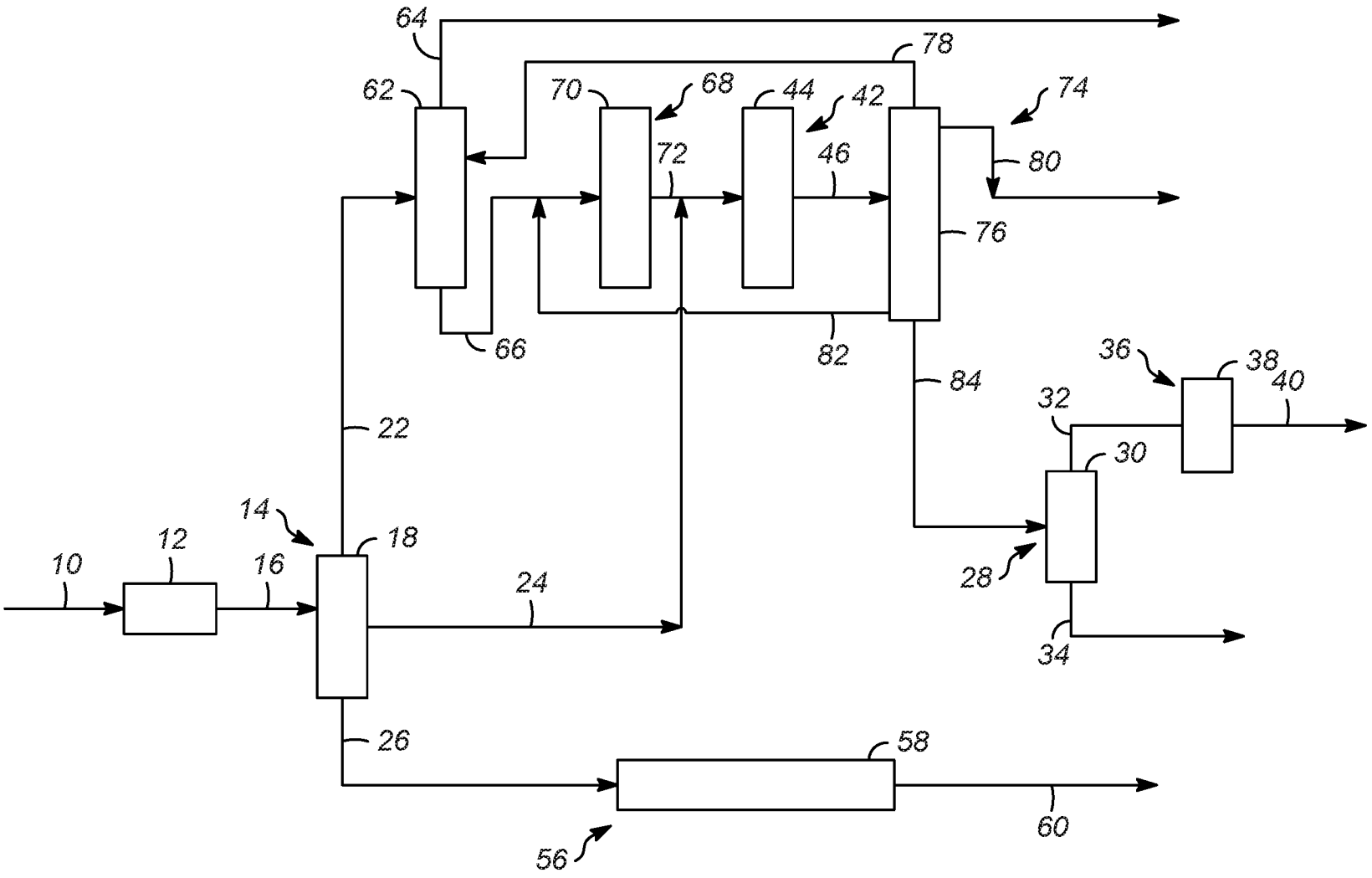
FIG. 6 shows a process flow diagram according to various aspects of the present invention.

Turning to FIGS. 4 to 6, it is also contemplated that the $C_6$ isomerization effluent 72 is passed to the $C_7$ isomerization zone 42. Accordingly, in FIG. 4, the $C_7$ stream 24 from the fractionation zone 14 is passed first to the $C_7$ separation zone 28 which provides the $iC_7$ stream 32 and the $nC_7$ and MCH stream 34. The $iC_7$ stream 32 is passed to the $C_7$ dehydrogenation zone 36 as discussed above. The $nC_7$ and MCH stream 34 is combined with the $C_6$ isomerization effluent 72 and then both are passed to the $C_7$ isomerization zone 42. From the $C_7$ isomerization zone 42, the $C_7$ isomerization effluent 46 (which also includes the $C_6$ isomerization effluent 72) is passed to the fractionation zone 74, where the fractionation column 76 separates the components and provides the streams 78, 80, 82, and 84 discussed above. The remaining portions of this embodiment are the same as the others and are hereby incorporated herein as if set forth fully.

In FIG. 5, alternatively the bottoms stream 84 from the fractionation column 76 is passed to the second $C_7$ separation zone 48 in which a fractionation column 50 provides the second $iC_7$ stream 52 and the MCH rich stream 54. The MCH rich stream 54 can be blended in the gasoline pool, while the second $iC_7$ stream 52 is combined with the first $iC_7$ stream 32 and passed to the $C_7$ dehydrogenation zone 36. The remaining portions of this embodiment are the same as the others and are hereby incorporated herein as if set forth fully.

Another embodiment is shown in FIG. 6 in which the entirety of the $C_7$ stream 24 from the fractionation zone 14 is passed the $C_7$ isomerization zone 42 with the $C_6$ isomerization effluent 72. Additionally, the bottoms stream 84 from the fractionation column 76 in this embodiment is passed to the $C_7$ separation zone 28 in which the $iC_7$ stream 32 and the $nC_7$ and MCH stream 34 are provided by the fractionation column 30 in the $C_7$ separation zone 28. The $iC_7$ stream 32 is passed to the $C_7$ dehydrogenation zone 36 providing the $C_7$ dehydrogenation effluent 40. The $C_7$ dehydrogenation effluent 40 and the $nC_7$ and MCH stream 34 can be blended to form a gasoline blend. The remaining portions of this embodiment are the same as the others and are hereby incorporated herein as if set forth fully.

Turning to FIGS. 7 to 12, in these embodiments $iC_7$ is separated from other $C_7$ components in the fractionation zone 14. More specifically in the fractionation column 18' of the fractionation zone 14, the naphtha feed stream 10 (or hydrotreated effluent 16) is separated into at least the $C_6$ stream 22, a first $C_7$ stream 24*a* comprising $iC_7$, a second $C_7$ stream 24*b* comprising $nC_7$ and MCH, and the heavy stream 26. This separation scheme minimizes the amount of MCH in the first $C_7$ stream 24*a* comprising $iC_7$.

Figure 7:
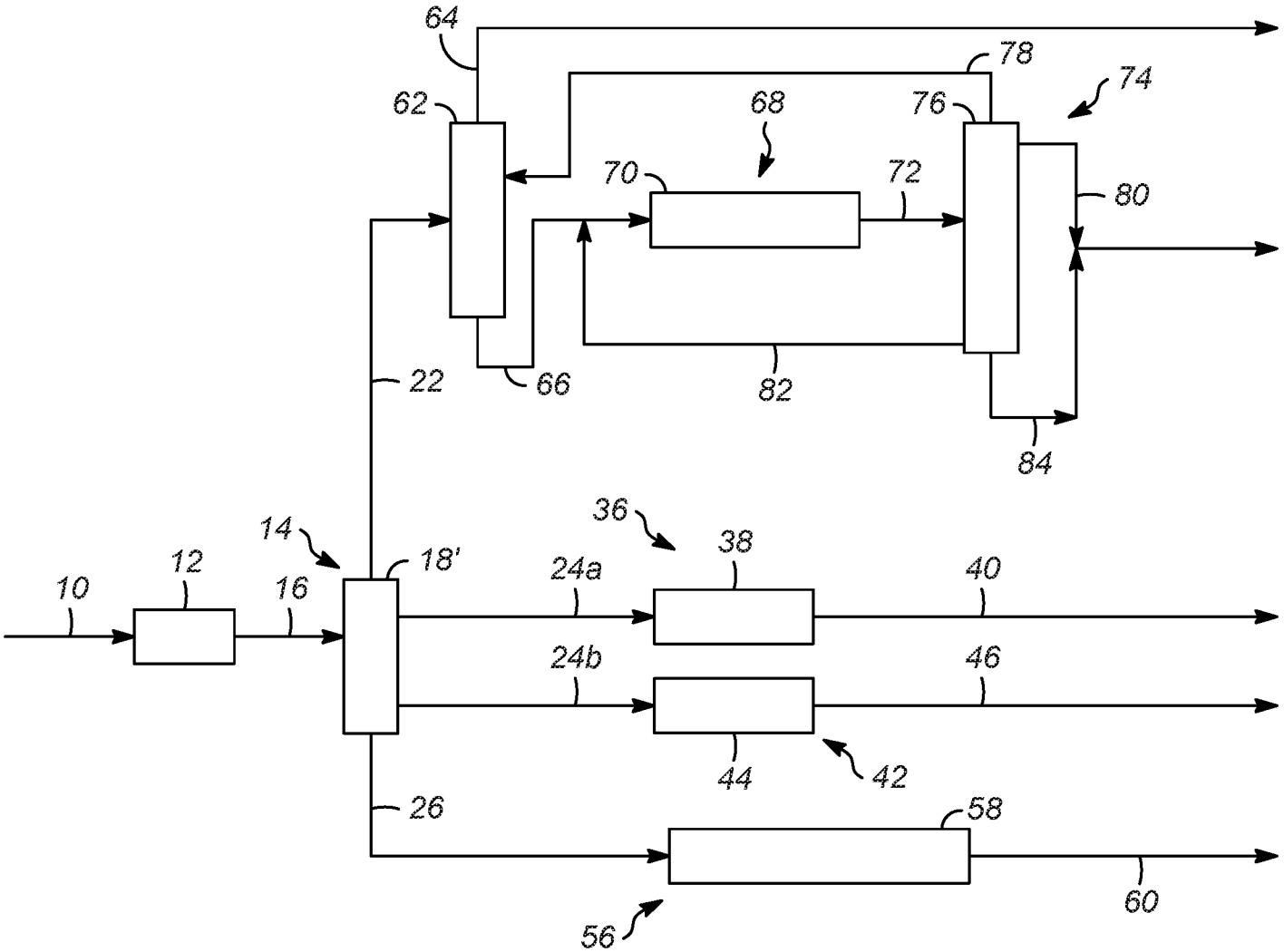
FIG. 7 shows a process flow diagram according to various aspects of the present invention.

In the embodiment of FIG. 7, the first $C_7$ stream 24*a* is passed to the $C_7$ dehydrogenation zone 36 and the $C_7$ dehydrogenation effluent 40 may, as discussed with the other embodiments, blended to form the gasoline blend. Once again, the $C_7$ dehydrogenation effluent 40 may first be passed to a selective hydrogenation zone (not shown). The second $C_7$ stream 24*b* is passed to the $C_7$ isomerization zone 42, and, as also discussed above, the $C_7$ isomerization effluent 46 may be blended to form the gasoline blend. The remaining portions of this embodiment are the same as the others and are hereby incorporated herein as if set forth fully.

Figure 8:
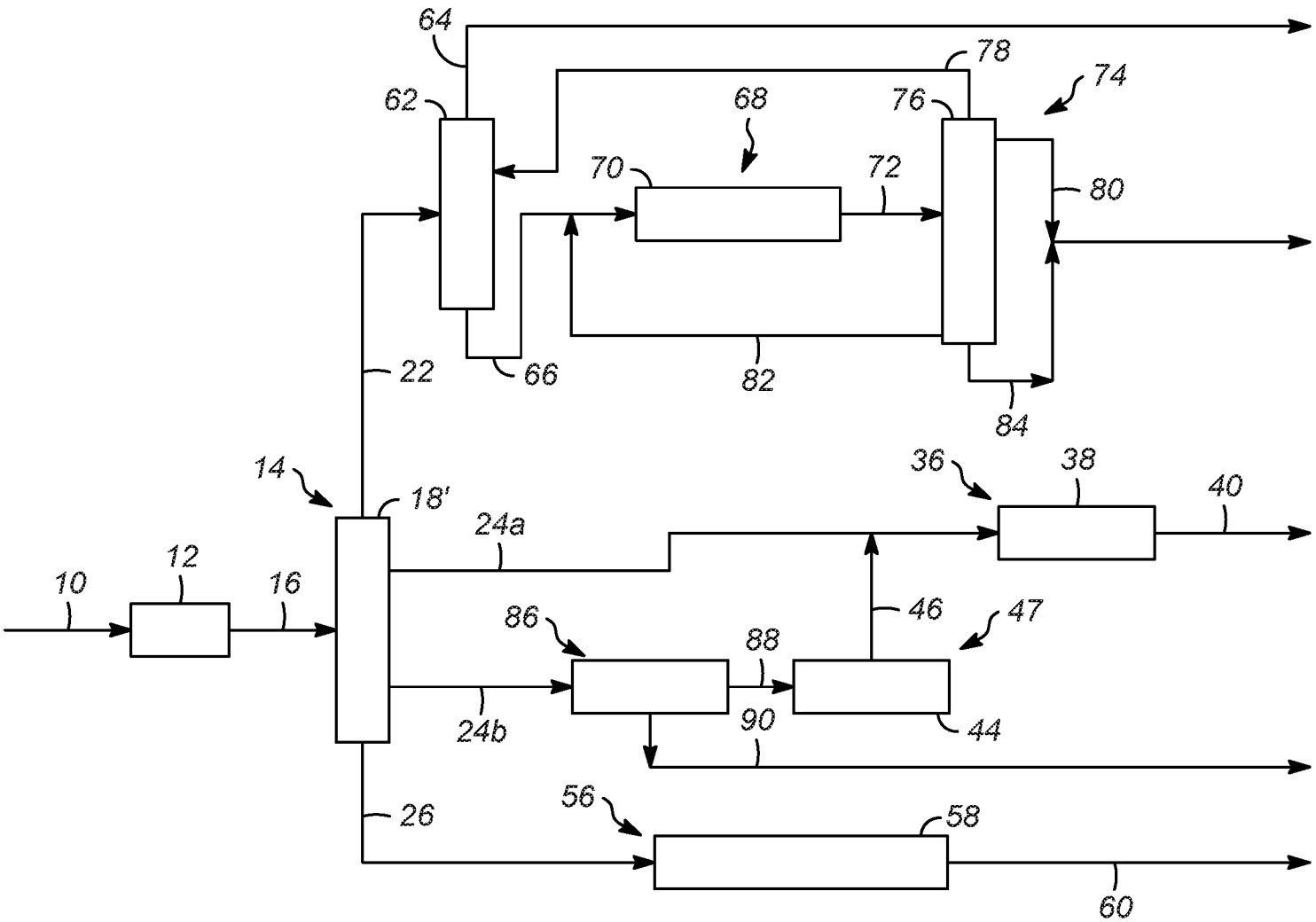
FIG. 8 shows a process flow diagram according to various aspects of the present invention.

In the embodiment of FIG. 8, an absorptive separation zone 86 is used to separate $nC_7$ and provide an $nC_7$ rich stream 88 and an MCH rich stream 90 from the second $C_7$ stream 24*b*. An exemplary absorptive separation zone 86 comprises one or more adsorbent chambers having one or more adsorbents that retain normal paraffins on the adsorbents located in the adsorption chambers to yield a raffinate stream comprising non-normal hydrocarbons. As is known, a desorbent, such as a hydrocarbon desorbent having twelve carbon atoms, is used to desorb the retained normal paraffins in an extract stream. Such an absorptive separation zone 86 is described in detail in U.S. Pat. Nos. 8,283,511 and 6,407,301, both of which are incorporated herein by reference. The MCH rich stream 90 can be blended to form the gasoline. The $nC_7$ rich stream 88 may be passed to the $C_7$ isomerization zone 42 and then the $C_7$ isomerization effluent 46 is passed to the $C_7$ dehydrogenation zone 36. The remaining portions of this embodiment are the same as the others and are hereby incorporated herein as if set forth fully.

Figure 9:
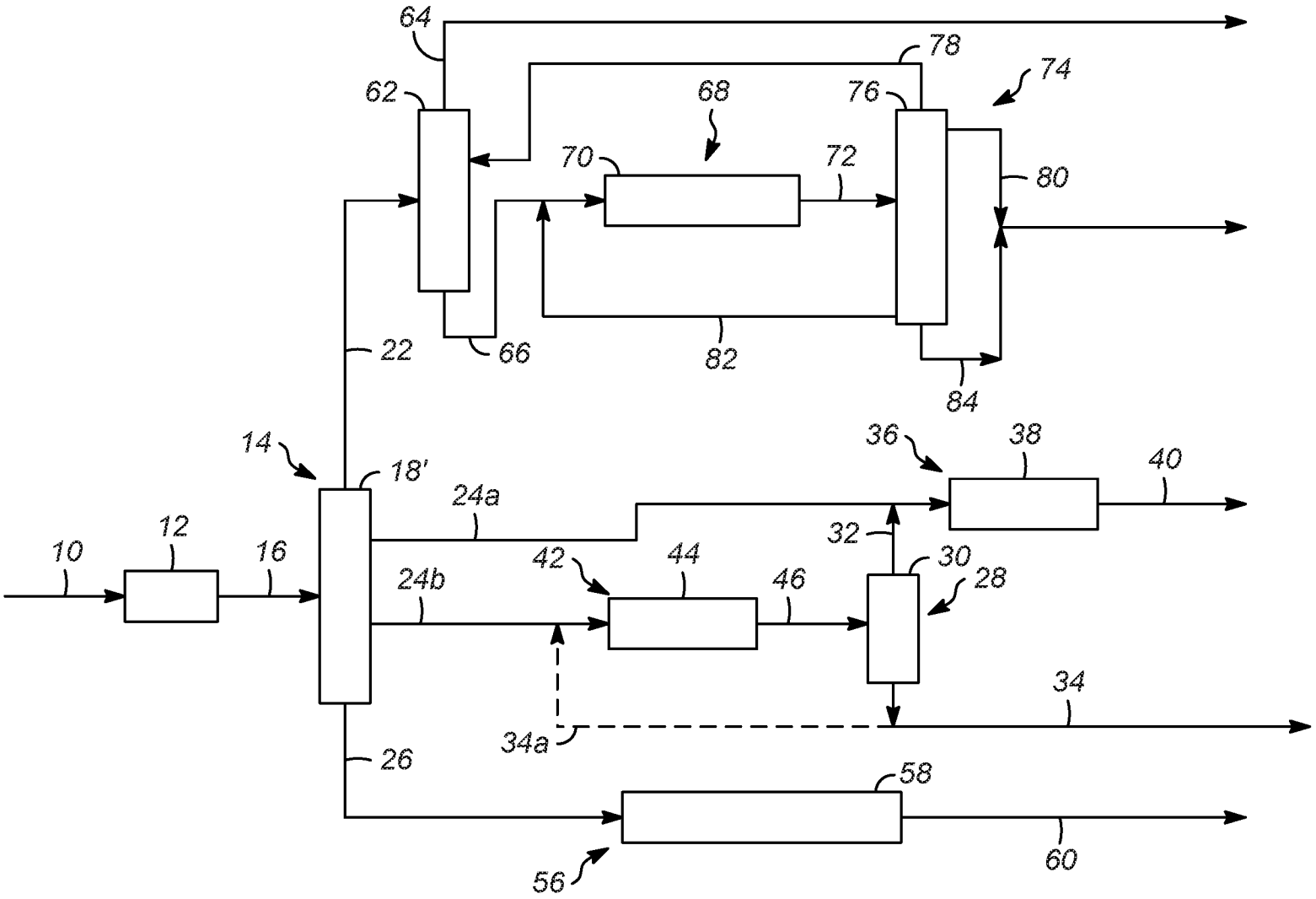
FIG. 9 shows a process flow diagram according to various aspects of the present invention.
Figure 10:
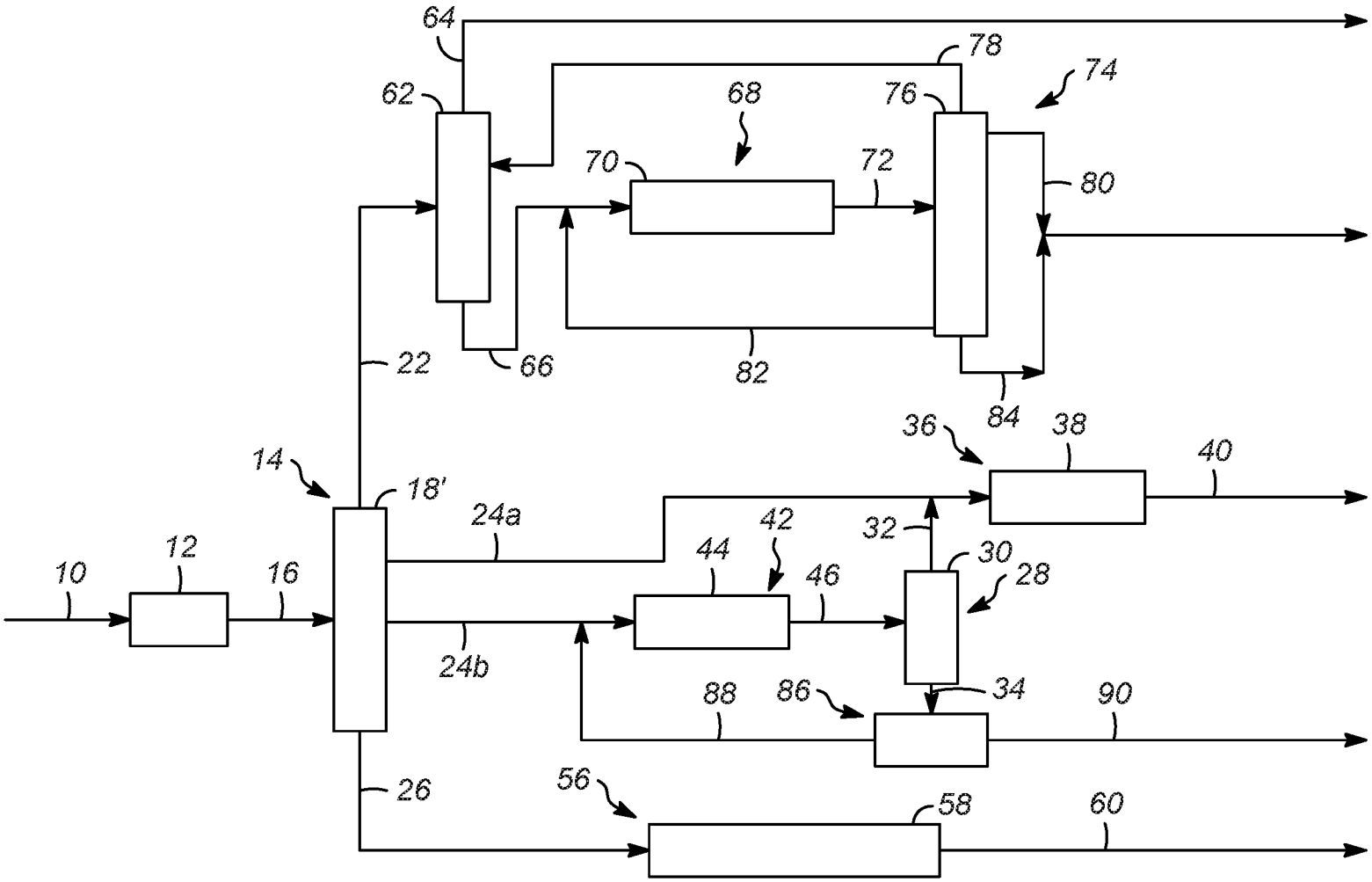
FIG. 10 shows a process flow diagram according to various aspects of the present invention.

In the embodiments shown in FIGS. 9 and 10, the second $C_7$ stream 24*b* is passed to the $C_7$ isomerization zone 42 and the $C_7$ isomerization effluent 46 is passed to the $C_7$ separation zone 28 which provides the $iC_7$ stream 32 and the $nC_7$ and MCH stream 34. As with other embodiments, the $iC_7$ stream 32 is passed to the $C_7$ dehydrogenation zone 36. In the embodiment of FIG. 9, the $nC_7$ and MCH stream 34 is blended to form the gasoline blend, with a portion 34*a* optionally being recycled to the $C_7$ isomerization zone 42. Alternatively, as shown in FIG. 10, the $nC_7$ and MCH stream 34 from the $C_7$ separation zone 28 may be passed to the absorptive separation zone 86 is used to separate $nC_7$ and provide the $nC_7$ rich stream 88 and the MCH rich stream 90. The $nC_7$ rich stream 88 is fed to the $C_7$ isomerization zone 42, while the MCH rich stream 90 is blended to form the gasoline blend. The remaining portions of these embodiments are the same as the others and are hereby incorporated herein as if set forth fully.

Figure 11:
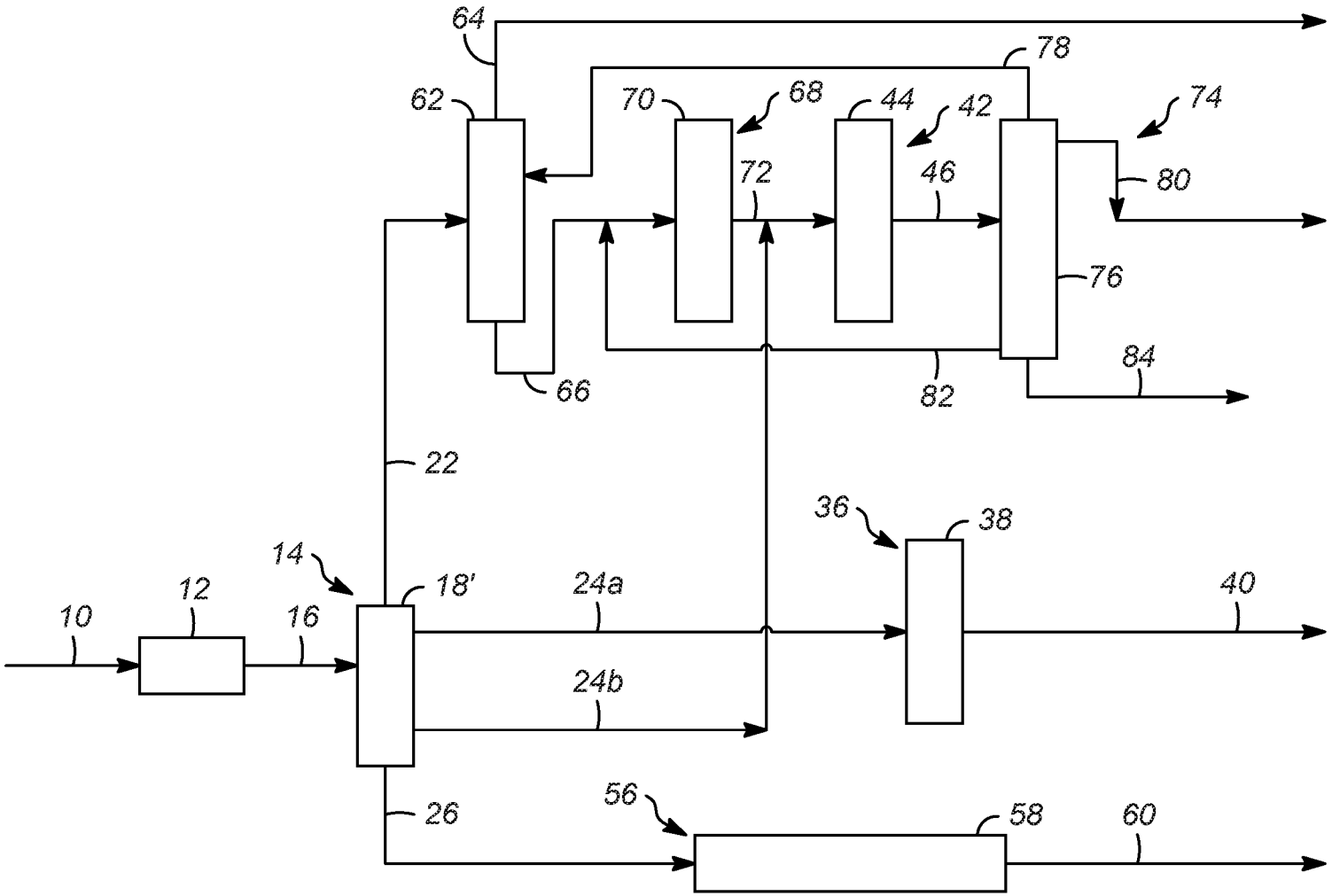
FIG. 11 shows a process flow diagram according to various aspects of the present invention; and, FIG. 12 shows a process flow diagram according to various aspects of the present invention.
Figure 12:
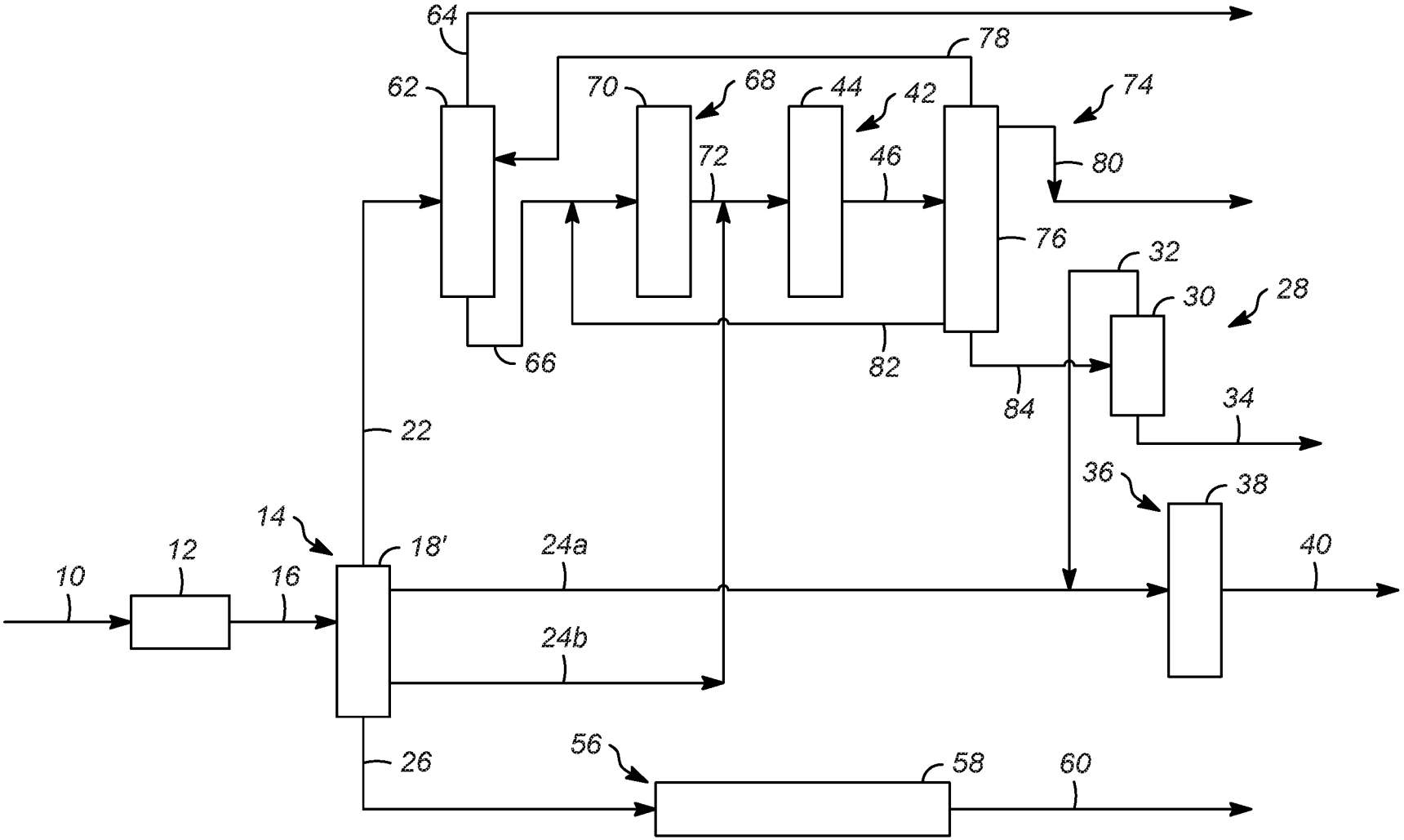

Finally, in the embodiments of FIGS. 11 and 12, the second $C_7$ stream 24*b* from the fractionation column 18' is combined with the $C_6$ isomerization zone effluent 72. The remaining portions of these embodiments are the same as those in FIGS. 4 and 6, respectively, and therefore the descriptions of those embodiments are hereby incorporated herein as if set forth fully.

Example 1

When $nC_7$ is dehydrogenated to the corresponding normal $C_7$ mono-olefins, the octane numbers range between 54.5 to 90.2 RON with an average of 77.0 RON as listed in Table 1, below. When a single-branched $iC_7$ paraffin such as 3-methylhexane for example is dehydrogenated to the corresponding $iC_7$ mono-olefins, the octane numbers range between 82.2 to 98.6 RON with an average of 92.5 RON. When multi-branched $iC_7$ paraffins such as 2,2-dimethylpentane, 2,4-deimethylpentane and 3,3-deimethylpentane for example are dehydrogenated to the corresponding multi-branched $iC_7$ mono-olefins, the octane numbers range from 99.2 to 105.3 RON with averages of 100.2-103.1 RON as shown in Table 1. Therefore, in terms of octane increase, it is more advantageous to dehydrogenate single-branched $iC_7$ paraffins as compared to $nC_7$ and it is most advantageous to dehydrogenate multi-branched $iC_7$ paraffins which have the highest mono-olefin octanes.

TABLE 1

Pure component octanes (RON) for $C_7$ hydrocarbons.

| Paraffin | Corresponding Mono-Olefins | API Database RON | Phillip 66 Database RON |
|---|---|---|---|
| $nC_7$ | 1-heptene | 54.5 | 54.5 |
| | t-2-heptene | 73.4 | 73.4 |
| | t-3-heptene | 89.8 | 89.8 |
| | c-3-heptene | 90.2 | 90.2 |
| | Average | 77.0 | 77.0 |
| 3-MH | 3-methyl-1-hexene | 82.2 | 82.2 |
| | 4-methyl-1-hexene | 86.4 | 86.4 |
| | cis-3-methyl-2-hexene | 92.4 | 92.4 |
| | trans-3-methyl-2-hexene | 91.5 | 91.5 |
| | cis-4-methyl-2-hexene | 98.6 | 98.6 |
| | trans-4-methyl-2-hexene | 96.8 | 96.8 |
| | cis-3-methyl-3-hexene | 96.0 | 96.0 |
| | trans-3-methyl-3-hexene | 96.4 | 96.4 |
| | Average | 92.5 | 92.5 |
| 2,2-DMP | 4,4-dimethyl-1-pentene | 100.4 | 105.4 |
| | 4,4-dimethyl-c-2-pentene | 100.5 | 105.3 |
| | 4,4-dimethyl-t-2-pentene | 100.5 | 105.3 |
| 2,4-DMP | 2,4-dimethyl-1-pentene | 99.2 | 99.2 |
| | 2,4-dimethyl-2-pentene | 100.0 | 100.0 |
| 3,3-DMP | 3,3-dimethyl-1-pentene | 100.3 | 103.5 |
| | Average | 100.2 | 103.1 |

Example 2

Table 2, below, shows that it is important to fractionate as much of the cyclohexane and benzene from the front end of the $iC_7$ stream that is sent the dehydrogenation zone to prevent cyclohexane from dehydrogenating to form benzene. It is evident that some multi-branched $iC_7$ paraffins co-boil with cyclohexane and will be excluded. The $iC_7$ stream will contain some multi-branched $iC_7$ paraffins but will be rich in single-branched $iC_7$ paraffins. Table 2 also shows that $nC_7$ and MCH have relatively close boiling points and above the $iC_7$ paraffins, therefore a $nC_7$+MCH stream can be fractionated. To obtain the desired cuts, it is envisioned that additional trays can be added to the fractionation columns, or a divided wall can be utilized inside the columns or other known techniques to improve the fractionation between the $C_7$ species can be utilized.

TABLE 2

Normal boiling points from the API Databook.

| Carbon Number | API Normal Boiling Points, ° C. (° F.) | Hydrocarbon Component |
|---|---|---|
| 6 | 80.7 (177.3) | CYCLOHEXANE |
| 6 | 80.1 (176.2) | BENZENE |
| 7 | 79.2 (174.6) | 2,2-DIMETHYLPENTANE |
| 7 | 80.5 (176.9) | 2,4-DIMETHYLPENTANE |
| 7 | 80.9 (177.6) | 2,2,3-TRIMETHYLBUTANE |
| 7 | 86.1 (186.9) | 3,3 -DIMETHYLPENTANE |
| 7 | 89.8 (193.6) | 2,3 -DIMETHYLPENTANE |
| 7 | 90.1 (194.1) | 2-METHYLHEXANE |
| 7 | 91.8 (197.3) | 3-METHYLHEXANE |
| 7 | 93.5 (200.3) | 3-ETHYLPENTANE |
| 7 | 98.4 (209.2) | n-HEPTANE |
| 7 | 87.8 (190.1) | 1,1 -DIMETHYLCYCLOPENTANE |
| 7 | 91.7 (197.1) | trans-1,3 -DIMETHYLCYCLOPENTANE |
| 7 | 91.9 (197.4) | trans-1,2-DIMETHYLCYCLOPENTANE |
| 7 | 100.9 (213.7) | METHYLCYCLOHEXANE |
| 7 | 103.4 (218.2) | ETHYLCYCLOPENTANE |
| 7 | 110.6 (231.1) | TOLUENE |

Example 3

From pilot plant data, a dehydrogenation model was formulated and placed into a process simulator to estimate the temperature drop over a single dehydrogenation reactor and the products formed. The process conditions of the dehydrogenation reactor (layered catalyst with the outer layer comprising gamma alumina with dispersed metals Pt, Sn, and Li) were set to 565° C. (1049° F.) inlet temperature, 137.9 kPa (20 psig), 10 $h^{-1}$ LHSV, and hydrogen/hydrocarbon mole ratio of three. A dehydrogenation feed that was MCH-free was selected to demonstrate the effect of allowing MCH into the dehydrogenation reactor. The MCH-free feed consisted of 11.7 wt % n-heptane, 21.3 wt % 2-methylhexane, 19.9 wt % 3-methylhexane, 1.6 wt % 3-ethylpentane, 34.3 wt % multi-branched $C_7$ isoparaffins, and 11.2 wt % $C_7$ cyclopentanes.

Table 3, below, shows the results of the process simulations for the MCH-free feed and the feeds that contained increasing amounts of MCH. For the MCH-free feed, the highest $C_7$ conversion to olefins and the highest product octane was realized. The small amount of toluene formed was due to $C_7$ paraffin reaction to aromatics via a sequential dehydrogenation pathway that is thought to occur on the metal sites at high temperatures. As the MCH increased in the dehydrogenation feed, the outlet temperature was lower (quench), the conversion of $C_7$ paraffins to olefins decreased, the octane decreased, and the toluene produced increased substantially. Therefore, to achieve appreciable conversions to olefins and to minimize the production of toluene, it is important to route MCH away from the dehydrogenation reactor.

TABLE 3

Dehydrogenation simulation results for C7 streams with increasing MCH content.

| Dehydrogenation Case | A | B | C | D | E |
|---|---|---|---|---|---|
| MCH in Dehydrogenation Feed, wt % | 0.0 | 5.0 | 10.0 | 15.0 | 25.0 |
| Inlet Temperature, ° C. | 565 | 565 | 565 | 565 | 565 |
| Outlet Temperature, ° C. | 515 | 501 | 486 | 470 | 428 |
| $C_7$ Conversion to Olefins, % | 20.4 | 16.2 | 11.6 | 6.7 | 0.5 |
| $C_4$+ RON | 80.1 | 79.0 | 77.7 | 77.1 | 78.0 |
| Multi-branched $C_7$ Olefins, LV % | 6.5 | 4.9 | 3.4 | 1.9 | 0.1 |
| Single-branched $C_7$ Olefins, LV % | 8.1 | 6.1 | 4.2 | 2.4 | 0.2 |
| Normal $C_7$ Olefins, LV % | 2.2 | 1.7 | 1.1 | 0.6 | 0.0 |
| $C_7$ Cyclic Olefins, LV % | 4.5 | 2.4 | 0.3 | 0.0 | 0.0 |
| Toluene, LV% | 2.0 | 6.0 | 10.0 | 14.0 | 22.6 |

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

SPECIFIC EMBODIMENTS

While the following is described in conjunction with specific embodiments, it will be understood that this description is intended to illustrate and not limit the scope of the preceding description and the appended claims.

A first embodiment of the invention is a process for producing a gasoline blend, the process comprising separating a naphtha feed in a fractionation column into a stream comprising $C_6$ and lighter boiling hydrocarbons, one or more $C_7$ hydrocarbon streams comprising methylcyclohexane, $iC_7$, and $nC_7$, and a heavy stream comprising $C_8$ hydrocarbons; isomerizing, in a $C_6$ isomerization zone at isomerization conditions, at least a portion of the stream comprising $C_6$ and lighter boiling hydrocarbons to form a $C_6$ isomerization effluent; isomerizing, in a $C_7$ isomerization zone at isomerization conditions, at least the $nC_7$ from the one or more $C_7$ hydrocarbon streams comprising methylcyclohexane, $iC_7$, and $nC_7$ to form a $C_7$ isomerization effluent; dehydrogenating, in a $C_7$ dehydrogenation zone at dehydrogenation conditions, the $iC_7$ from the one or more $C_7$ hydrocarbon streams comprising methylcyclohexane, $iC_7$, and $nC_7$ to form a $C_7$ dehydrogenation effluent, wherein the methylcyclohexane of the one or more $C_7$ hydrocarbon stream comprising methylcyclohexane, $iC_7$, and $nC_7$ bypasses the $C_7$ dehydrogenation zone; reforming, in a reforming zone under reforming conditions, the heavy stream to form a reformate stream; and, blending the $C_6$ isomerization effluent, the reformate stream, the $C_7$ dehydrogenation effluent, and the $C_7$ isomerization effluent to form the gasoline blend. An embodiment of the invention is one, any or all of prior embodiments in this paragraph up through the first embodiment in this paragraph wherein the fractionation column provides a hydrocarbon stream comprising methylcyclohexane, $iC_7$, and $nC_7$ as the one or more $C_7$ hydrocarbon streams comprising methylcyclohexane, $iC_7$, and $nC_7$. An embodiment of the invention is one, any or all of prior embodiments in this paragraph up through the first embodiment in this paragraph further comprising separating, in a $C_7$ separation zone, the hydrocarbon stream comprising methylcyclohexane, $iC_7$, and $nC_7$ into an $iC_7$ stream and an $nC_7$ and MCH stream. An embodiment of the invention is one, any or all of prior embodiments in this paragraph up through the first embodiment in this paragraph further comprising passing the $iC_7$ stream from the $C_7$ separation zone to the $C_7$ dehydrogenation zone; and, passing the $nC_7$ and MCH stream from the $C_7$ separation zone to the $C_7$ isomerization zone. An embodiment of the invention is one, any or all of prior embodiments in this paragraph up through the first embodiment in this paragraph further comprising recycling a portion of the $C_7$ isomerization effluent to the $C_7$ separation zone. An embodiment of the invention is one, any or all of prior embodiments in this paragraph up through the first embodiment in this paragraph further comprising separating, in a second $C_7$ separation zone, the $C_7$ isomerization effluent into a second $iC_7$ stream and an MCH rich stream. An embodiment of the invention is one, any or all of prior embodiments in this paragraph up through the first embodiment in this paragraph further comprising passing the second $iC_7$ stream from the second $C_7$ separation zone to the $C_7$ dehydrogenation zone. An embodiment of the invention is one, any or all of prior embodiments in this paragraph up through the first embodiment in this paragraph further comprising combining the $C_7$ stream comprising $C_7$ hydrocarbons with the $C_6$ isomerization effluent and passing the combined stream to the $C_7$ isomerization zone. An embodiment of the invention is one, any or all of prior embodiments in this paragraph up through the first embodiment in this paragraph further comprising separating, in a second $C_7$ separation zone, a portion of the combined $C_6$ and $C_7$ isomerization effluent into a second $iC_7$ stream and an MCH rich stream. An embodiment of the invention is one, any or all of prior embodiments in this paragraph up through the first embodiment in this paragraph further comprising passing the second $iC_7$ stream from the second $C_7$ separation zone to the $C_7$ dehydrogenation zone. An embodiment of the invention is one, any or all of prior embodiments in this paragraph up through the first embodiment in this paragraph further comprising passing the hydrocarbon stream comprising methylcyclohexane, $iC_7$, and $nC_7$ to the $C_7$ isomerization zone. An embodiment of the invention is one, any or all of prior embodiments in this paragraph up through the first embodiment in this paragraph further comprising separating, in a $C_7$ separation zone, a portion of the $C_7$ isomerization effluent into an $iC_7$ stream and an MCH rich stream; and, passing the $iC_7$ stream to the $C_7$ dehydrogenation zone. An embodiment of the invention is one, any or all of prior embodiments in this paragraph up through the first embodiment in this paragraph further comprising recycling a portion of the MCH rich stream to the $C_7$ isomerization zone. An embodiment of the invention is one, any or all of prior embodiments in this paragraph up through the first embodiment in this paragraph further comprising combining the $C_7$ stream comprising $C_7$ hydrocarbons with the $C_6$ isomerization effluent and passing the combined stream to the $C_7$ isomerization zone. An embodiment of the invention is one, any or all of prior embodiments in this paragraph up through the first embodiment in this paragraph wherein the fractionation column provides, as the one or more $C_7$ hydrocarbon streams comprising methylcyclohexane, $iC_7$, and $nC_7$, a first $C_7$ hydrocarbon stream comprising $iC_7$ and a second $C_7$ hydrocarbon stream comprising methylcyclohexane and $nC_7$. An embodiment of the invention is one, any or all of prior embodiments in this paragraph up through the first embodiment in this paragraph further comprising passing the first $C_7$ hydrocarbon stream to the $C_7$ dehydrogenation zone; and, passing at least a portion of the second $C_7$ hydrocarbon stream to the $C_7$ isomerization zone. An embodiment of the invention is one, any or all of prior embodiments in this paragraph up through the first embodiment in this paragraph further comprising separating, in a $C_7$ separation zone, the second $C_7$ hydrocarbon stream into an MCH rich stream and an $nC_7$ rich stream; passing the $nC_7$ rich stream to the $C_7$ isomerization zone; and, passing the $C_7$ isomerization effluent to the $C_7$ dehydrogenation zone. An embodiment of the invention is one, any or all of prior embodiments in this paragraph up through the first embodiment in this paragraph further comprising separating, in a $C_7$ separation zone, the $C_7$ isomerization effluent into an $iC_7$ rich stream and an MCH rich stream; and, passing the $iC_7$ rich stream to the $C_7$ dehydrogenation zone. An embodiment of the invention is one, any or all of prior embodiments in this paragraph up through the first embodiment in this paragraph further comprising recycling a portion of the MCH rich stream to the $C_7$ isomerization zone. An embodiment of the invention is one, any or all of prior embodiments in this paragraph up through the first embodiment in this paragraph further comprising separating, in a second $C_7$ separation zone, a stream of $nC_7$ from the isomerization effluent, wherein the stream of $nC_7$ comprises the portion of the MCH rich stream recycled to the $C_7$ isomerization zone. An embodiment of the invention is one, any or all of prior embodiments in this paragraph up through the first embodiment in this paragraph further comprising combining the $C_7$ stream comprising $C_7$ hydrocarbons with the $C_6$ isomerization effluent and passing the combined stream to the $C_7$ isomerization zone. An embodiment of the invention is one, any or all of prior embodiments in this paragraph up through the first embodiment in this paragraph further comprising separating, in a second $C_7$ separation zone, a portion of the combined $C_6$ and $C_7$ isomerization effluent into a second $iC_7$ stream and a methylcyclohexane rich stream. 23 An embodiment of the invention is one, any or all of prior embodiments in this paragraph up through the first embodiment in this paragraph further comprising passing the second $iC_7$ stream from the second $C_7$ separation zone to the $C_7$ dehydrogenation zone.

A second embodiment of the invention is a process for producing a gasoline blend, the process comprising separating a naphtha feed into a stream comprising $C_6$ and lighter boiling hydrocarbons, a $C_7$ hydrocarbon stream comprising methylcyclohexane, $iC_7$, and $nC_7$, and a heavy stream comprising $C_8$ hydrocarbons; isomerizing, in a $C_6$ isomerization zone at isomerization conditions, at least a portion of the stream comprising $C_6$ and lighter boiling hydrocarbons to form a $C_6$ isomerization effluent; separating the $C_7$ hydrocarbon stream in a $C_7$ separation zone into an $iC_7$ stream and an $nC_7$ and methylcyclohexane stream; isomerizing, in a $C_7$ isomerization zone at isomerization conditions, the $nC_7$ and methylcyclohexane stream from the $C_7$ separation zone to form a $C_7$ isomerization effluent; dehydrogenating, in a $C_7$ dehydrogenation zone at dehydrogenation conditions, the $iC_7$ from the $C_7$ separation zone to form a $C_7$ dehydrogenation effluent; reforming, in a reforming zone under reforming conditions, the heavy stream to form a reformate stream; and, blending the $C_6$ isomerization effluent, the reformate stream, the $C_7$ dehydrogenation effluent, and the $C_7$ isomerization effluent to form the gasoline blend.

A third embodiment of the invention is a process for producing a gasoline blend, the process comprising separating a naphtha feed into a stream comprising $C_6$ and lighter boiling hydrocarbons, a $C_7$ hydrocarbon stream comprising methylcyclohexane, $iC_7$, and $nC_7$, and a heavy stream comprising $C_8$ hydrocarbons; isomerizing, in a $C_6$ isomerization zone at isomerization conditions, at least a portion of the stream comprising $C_6$ and lighter boiling hydrocarbons to form a $C_6$ isomerization effluent; isomerizing, in a $C_7$ isomerization zone at isomerization conditions, the $C_7$ hydrocarbon stream comprising methylcyclohexane, $iC_7$, and $nC_7$ to form a $C_7$ isomerization effluent; separating the $C_7$ isomerization effluent in a $C_7$ separation zone into an $iC_7$ stream and an MCH rich stream; dehydrogenating, in a $C_7$ dehydrogenation zone at dehydrogenation conditions, the $iC_7$ stream; reforming, in a reforming zone under reforming conditions, the heavy stream to form a reformate stream; and, blending the $C_6$ isomerization effluent, the reformate stream, the $C_7$ dehydrogenation effluent, and the $C_7$ isomerization effluent to form the gasoline blend.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for producing a gasoline blend, the process comprising:

separating a naphtha feed in a fractionation column into a stream comprising C6 and lighter boiling hydrocarbons, one or more C7 hydrocarbon streams comprising methylcyclohexane, iC7, and nC7, and a heavy stream comprising C8 hydrocarbons;

isomerizing, in a C6 isomerization zone at isomerization conditions, at least a portion of the stream comprising C6 and lighter boiling hydrocarbons to form a C6 isomerization effluent;

isomerizing, in a C7 isomerization zone at isomerization conditions, at least the nC7 from the one or more C7 hydrocarbon streams comprising methylcyclohexane, iC7, and nC7 to form a C7 isomerization effluent;

dehydrogenating, in a C7 dehydrogenation zone at dehydrogenation conditions, the iC7 from the one or more C7 hydrocarbon streams comprising methylcyclohexane, iC7, and nC7 to form a C7 dehydrogenation effluent, wherein the methylcyclohexane of the one or more C7 hydrocarbon stream comprising methylcyclohexane, iC7, and nC7 bypasses the C7 dehydrogenation zone;

reforming, in a reforming zone under reforming conditions, the heavy stream to form a reformate stream; and, blending the C6 isomerization effluent, the reformate stream, the C7 dehydrogenation effluent, and the C7 isomerization effluent to form the gasoline blend.

2. The process of claim 1 wherein the fractionation column provides a hydrocarbon stream comprising methylcyclohexane, iC7, and nC7 as the one or more C7 hydrocarbon streams comprising methylcyclohexane, iC7, and nC7.

3. The process of claim 2 further comprising:

separating, in a C7 separation zone, the hydrocarbon stream comprising methylcyclohexane, iC7, and nC7 into an iC7 stream and an nC7 and MCH stream.

4. The process of claim 3 further comprising:

passing the iC7 stream from the C7 separation zone to the C7 dehydrogenation zone; and, passing the nC7 and MCH stream from the C7 separation zone to the C7 isomerization zone.

5. The process of claim 4 further comprising:

recycling a portion of the C7 isomerization effluent to the C7 separation zone; and, separating, in a second C7 separation zone, the C7 isomerization effluent into a second iC7 stream and an MCH rich stream.

6. The process of claim 5 further comprising:

passing the second iC7 stream from the second C7 separation zone to the C7 dehydrogenation zone.

7. The process of claim 1 further comprising:

combining the C7 stream comprising C7 hydrocarbons with the C6 isomerization effluent and passing the combined stream to the C7 isomerization zone.

8. The process of claim 7 further comprising:

separating, in a second C7 separation zone, a portion of the combined C6 and C7 isomerization effluent into a second iC7 stream and an MCH rich stream.

9. The process of claim 8 further comprising:

passing the second iC7 stream from the second C7 separation zone to the C7 dehydrogenation zone.

10. The process of claim 2 further comprising:

passing the hydrocarbon stream comprising methylcyclohexane, iC7, and nC7 to the C7 isomerization zone.

11. The process of claim 10 further comprising:

separating, in a C7 separation zone, a portion of the C7 isomerization effluent into an iC7 stream and an MCH rich stream; and, passing the iC7 stream to the C7 dehydrogenation zone.

12. The process of claim 11 further comprising:

combining the C7 stream comprising C7 hydrocarbons with the C6 isomerization effluent and passing the combined stream to the C7 isomerization zone.

13. The process of claim 1 wherein the fractionation column provides, as the one or more C7 hydrocarbon streams comprising methylcyclohexane, iC7, and nC7, a first C7 hydrocarbon stream comprising iC7 and a second C7 hydrocarbon stream comprising methylcyclohexane and nC7.

14. The process of claim 13 further comprising:

passing the first C7 hydrocarbon stream to the C7 dehydrogenation zone; and, passing at least a portion of the second C7 hydrocarbon stream to the C7 isomerization zone.

15. The process of claim 14 further comprising:

separating, in a C7 separation zone, the second C7 hydrocarbon stream into an MCH rich stream and an nC7 rich stream;

passing the nC7 rich stream to the C7 isomerization zone; and, passing the C7 isomerization effluent to the C7 dehydrogenation zone.

16. The process of claim 14 further comprising:

separating, in a C7 separation zone, the C7 isomerization effluent into an iC7 rich stream and an MCH rich stream; and, passing the iC7 rich stream to the C7 dehydrogenation zone.

17. The process of claim 16 further comprising:

recycling a portion of the MCH rich stream to the C7 isomerization zone; and, separating, in a second C7 separation zone, a stream of nC7 from the isomerization effluent, wherein the stream of nC7 comprises the portion of the MCH rich stream recycled to the C7 isomerization zone.

18. The process of claim 14 further comprising:

combining the C7 stream comprising C7 hydrocarbons with the C6 isomerization effluent and passing the combined stream to the C7 isomerization zone.

19. The process of claim 18 further comprising:

separating, in a second C7 separation zone, a portion of the combined C6 and C7 isomerization effluent into a second iC7 stream and a methylcyclohexane rich stream.

20. The process of claim 19 further comprising:

passing the second iC7 stream from the second C7 separation zone to the C7 dehydrogenation zone.

* * * * *